US007422300B2

(12) United States Patent
Yamanobe

(10) Patent No.: US 7,422,300 B2
(45) Date of Patent: Sep. 9, 2008

(54) IMAGE FORMING APPARATUS AND IMAGE FORMING METHOD

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 342 days.

(21) Appl. No.: 11/237,693

(22) Filed: Sep. 29, 2005

(65) Prior Publication Data

US 2006/0071991 A1 Apr. 6, 2006

(30) Foreign Application Priority Data

Sep. 30, 2004 (JP) ..... 2004-288785

(51) Int. Cl.
*B41J 29/38* (2006.01)

(52) U.S. Cl. ..... 347/14; 347/15

(58) Field of Classification Search ..... 347/14, 347/15, 93, 95, 43
See application file for complete search history.

(56) References Cited

U.S. PATENT DOCUMENTS 6,158,834 A * 12/2000 Kato et al. ..... 347/9
6,412,934 B1 * 7/2002 Moriyama et al. ..... 347/96
6,474,778 B1 * 11/2002 Koitabashi et al. ..... 347/43
6,834,947 B2 * 12/2004 Moriyama et al. ..... 347/96
2007/0002382 A1 * 1/2007 Yamazaki ..... 358/3.03

FOREIGN PATENT DOCUMENTS

| | | | |
|---|---|---|---|
| JP | 6-255096 | A | 9/1994 |
| JP | 8-52867 | A | 2/1996 |
| JP | 8-72231 | A | 3/1996 |
| JP | 8-72233 | A | 3/1996 |
| JP | 8-216389 | A | 8/1996 |

* cited by examiner

*Primary Examiner*—Thinh H Nguyen
(74) *Attorney, Agent, or Firm*—Birch, Stewart, Kolasch & Birch, LLP

(57) ABSTRACT

The image forming apparatus comprises: an ink application device which applies ink to a recording medium; a treatment liquid application device which applies treatment liquid which causes the ink to increase in viscosity or solidify, by reacting with the ink; an image processing device which generates image data of multiple values from an input image; a block dividing device which divides an image region to be formed on the recording medium according to the image data into a plurality of blocks; an evaluation value calculation device which calculates an evaluation value for each of the blocks for judging an application of the treatment liquid to each of the blocks, according to the image data; and a treatment liquid application control device which controls a mode of applying the treatment liquid to each of the blocks, by comparing the evaluation value with a previously established threshold value.

19 Claims, 14 Drawing Sheets

FIG.10

SUB-SCANNING DIRECTION

Nx → MAIN SCANNING DIRECTION

| | | | |
|---|---|---|---|
| (0, 0) | (1, 0) | ··· | (Nx −1, 0) |
| (0, 1) | (1, 1) | ··· | (Nx −1, 1) |
| ··· | ··· | ··· | ··· |
| (0, Ny−1) | (1, Ny−1) | ··· | (Nx −1, Ny −1) |

Ny

FIG.11

SUB-SCANNING DIRECTION

Nx → MAIN SCANNING DIRECTION

| | | | | | |
|---|---|---|---|---|---|
| | (M(0), 0) | (M(0)+1, 0) | ··· | (N(0), 0) | |
| (M(1), 1) | (M(1)+1, 1) | ··· | ··· | ··· | (N(1), 1) |
| ··· | ··· | ··· | ··· | ··· | ··· |
| | (M(Ny−1), Ny−1) | (M(Ny−1)+1, Ny−1) | ··· | (N(Ny−1), Ny−1) | |

Ny

IMAGE FORMING APPARATUS AND IMAGE FORMING METHOD

BACKGROUND OF THE INVENTION

1. Field of the Invention

The present invention relates to an image forming apparatus and an image forming method, and more particularly, to technology for increasing the viscosity of ink or solidifying (curing) ink by means of a two-liquid reaction between ink and a transparent treatment liquid, and thereby preventing deposition interference between inks, bleeding into the recording medium, bleeding due to overlapping of ink droplets of different colors, and the like.

2. Description of the Related Art

Inkjet recording apparatuses (inkjet printers) having an inkjet head (ink ejection head) in which a plurality of nozzles are arranged, are known as image forming apparatuses. An inkjet recording apparatus of this kind forms images by forming dots on a recording medium, by ejecting ink as droplets from nozzles, while causing the inkjet head and the recording medium to move relatively to each other.

Various methods are known as ink ejection methods for an inkjet recording apparatus of this kind. For example, one known method is a piezoelectric method, where the volume of a pressure chamber (ink chamber) is changed by causing a diaphragm forming a portion of the pressure chamber to deform due to deformation of a piezoelectric element (piezoelectric actuator), ink being introduced into the pressure chamber from an ink supply passage when the volume is increased, and the ink inside the pressure chamber being ejected as a droplet from the nozzle when the volume of the pressure chamber is reduced. Another known method is a thermal inkjet method where ink is heated to generate a bubble in the ink, and ink is then ejected by means of the expansive energy created as the bubble grows.

In an inkjet recording apparatus, one image is represented by combining dots formed by ink ejected from the nozzles. In this case, it has been proposed that image quality can be improved, by mixing together two liquids, namely, transparent treatment liquid and ink, thereby increasing the viscosity of the ink or solidifying the ink, and thus preventing bleeding into the recording medium, or bleeding due to overlapping between ink droplets.

For example, a method is known in which it is sought to improve the quality of a recorded image by providing a device which applies a coating material (treatment liquid) onto a recording medium in accordance with a recording signal, before recording by means of the recording ink has been performed onto the recording medium, the coating material being deposited only onto the ink droplet deposition region of the recording medium, or alternatively, the droplet deposition density of the coating material being reduced below the droplet deposition density of the ink (see, for example, Japanese Patent Application Publication No. 6-255096).

Furthermore, for example, a method is also known in which an inkjet head which ejects treatment liquid that causes the coloring material in the ink to become insoluble or to aggregate is provided in addition to an inkjet head which ejects ink, and the recording region of the recording medium is divided up into blocks, no droplets of treatment liquid being deposited in a block where not one droplet of ink is to be deposited, and droplets of treatment liquid being deposited in a prescribed uniform droplet deposition pattern in a block where droplets of ink are to be deposited. Thereby, good water resistance is obtained in the recorded image, and furthermore, the image recording is free from bleeding at the boundaries between different colors (see, for example, Japanese Patent Application Publication No. 8-72231).

Moreover, for example, a method is known in which, when a prescribed number or more of ejection data for ejecting recording ink are present in recording data which corresponds to respective recording blocks obtained by dividing the recordable region of the recording medium into a plurality of regions, then a treatment liquid which causes the coloring material inside the recording ink to become insoluble or to aggregate is deposited over the whole area of that recording block, or alternatively, treatment liquid is deposited in a certain specified pattern which corresponds to the number of ink droplets to be deposited. In this way, excellent image quality is achieved while suppressing the amount of treatment liquid consumed. (See, for example, Japanese Patent Application Publication No. 8-72233).

As described above, in an inkjet printer based on a two-liquid reaction which prevents deposition interference between inks or bleeding by mixing treatment liquid and ink together and causing the ink to increase in viscosity or to solidify as a result of reaction between the two liquids, it has been proposed that the amount of treatment liquid used be restricted by dividing the image region on the recording medium up into blocks and deciding whether or not to deposit droplets of treatment liquid with respect to each block individually, on the basis of the recording data, with the object of reducing running costs and reducing the amount of treatment liquid and ink solvent, and so on. The condition for judging whether or not to deposit droplets of treatment liquid in each block is based on determining whether one or more droplet of ink is to be deposited in that block, or whether no ink droplet is to be deposited in that block (see, for example, Japanese Patent Application Publication Nos. 6-255096 and 8-72231), or this judgment is made by determining whether or not a prescribed number of more of ink droplets are to be deposited, without making any distinctions between the size of the ink droplets, or the like (see, Japanese Patent Application Publication No. 8-72233). Here, deposition interference refers to shifting of the dot formation positions from the prescribed landing position (the position of the liquid droplet upon landing) and/or disturbance of the dot shapes, due to coalescence between mutually adjacent liquid droplets on the recording medium.

However, in the case of extremely simple judgment conditions of this kind, there is a problem in that suitable judgment cannot be made in order to prevent image deterioration caused by deposition interference, bleeding into ordinary paper, bleeding between colors, and the like.

SUMMARY OF THE INVENTION

The present invention has been contrived in view of the foregoing circumstances, an object thereof being to provide an image forming apparatus and an image forming method whereby deposition interference between ink droplets, bleeding into the recording medium, and bleeding due to overlapping between ink droplets of different colors, and the like, can be prevented effectively by increasing the viscosity of the ink or solidifying (curing) the ink by means of a two-liquid reaction between the ink and a transparent treatment liquid.

In order to attain the aforementioned object, the present invention is directed to an image forming apparatus, comprising: an ink application device which applies ink to a recording medium; a treatment liquid application device which applies treatment liquid which causes the ink to increase in viscosity or solidify, by reacting with the ink; an image processing device which generates image data of multiple values from an input image; a block dividing device which divides an image region to be formed on the recording medium according to the image data into a plurality of blocks; an evaluation value calculation device which calculates an evaluation value for each of the blocks for judging an application of the treatment liquid to each of the blocks, according to the image data; and a treatment liquid application control device which controls a mode of applying the treatment liquid to each of the blocks, by comparing the evaluation value with a previously established threshold value.

According to the present invention, it is possible to reduce the amount of treatment liquid applied to the recording medium, and it is also possible to prevent deposition interference between ink droplets, and bleeding of ink.

Preferably, the evaluation value calculation device calculates the evaluation value by taking account of at least one of a size of ink dots applied to the recording medium, an overlapping between the ink dots, and a color of the ink, according to the image data. Accordingly, it is possible to prevent deposition interference between ink droplets and ink bleeding in an effective manner.

Preferably, when the treatment liquid application control device implements control whereby treatment liquid is applied to one of the blocks, then the treatment liquid application device applies one droplet of the treatment liquid to the one of the blocks. Accordingly, it is possible further to reduce the treatment liquid.

Preferably, the treatment liquid application device comprises a liquid ejection head which ejects the treatment liquid. Accordingly, it is possible to reduce noise and improve image quality in image recording.

Preferably, the blocks have a substantially hexagonal lattice shape. Accordingly, it is possible to prevent deposition interference between treatment liquid droplets, and it is also possible to reduce the visibility of the divided blocks and hence high image quality can be achieved.

Preferably, a length of a maximum diameter of the blocks is 150 μm or less. Accordingly, it is possible to reduce the visibility of the blocks, yet further.

Preferably, the image forming apparatus further comprises a threshold value recording device which records the threshold value in accordance with the recording medium. Accordingly, it is possible to form an optimal image in accordance with the recording medium used.

In order to attain the aforementioned object, the present invention is also directed to an image forming method, comprising the steps of: generating image data of multiple values from an input image; dividing an image region to be formed on a recording medium according to the image data into a plurality of blocks; calculating an evaluation value for judging whether or not to apply a treatment liquid causing ink to increase in viscosity or to solidify by reacting with the ink, onto each of the blocks, according to the image data for each of the blocks; controlling a mode of applying the treatment liquid to each of the blocks, by comparing the evaluation value with a previously established threshold value; and applying the ink and the treatment liquid to the recording medium.

According to the present invention, the amount of treatment liquid can be reduced, deposition interference between ink droplets and bleeding of the ink can be prevented, and hence high image quality can be achieved.

Preferably, in the step of calculating the evaluation value, the evaluation value is calculated for each of the blocks by taking account of at least one of a size of ink dots applied to the recording medium according to the image data. Accordingly, it is possible to prevent deposition interference between ink droplets in an effective manner.

Preferably, in the step of calculating the evaluation value, the evaluation value is calculated for each of the blocks by taking account of whether or not ink dots of a same color applied to the recording medium are mutually adjacent, according to the image data. By this means also, it is also possible to prevent deposition interference between ink droplets, effectively.

Preferably, in the step of calculating the evaluation value, the evaluation value is calculated for each of the blocks by taking account of whether or not ink dots of different colors applied to the recording medium are mutually overlapping, according to the image data. Accordingly, it is possible to prevent bleeding between inks of different colors, in an effective manner.

Preferably, in the step of calculating the evaluation value, the evaluation value is calculated for each of the blocks by taking account of a color of the ink dots applied to the recording medium, according to the image data. Accordingly, deposition interference between ink droplets is prevented effectively, and furthermore, the amount of treatment liquid can be prevented.

As described above, according to the image forming apparatus and the image forming method relating to the present invention, by increasing the viscosity of the ink or solidifying (curing) the ink by means of a two-liquid reaction between the treatment liquid and the ink, it is possible effectively to prevent deposition interference between ink droplets, and bleeding of ink into the recording medium, and furthermore, it is also possible to reduce the amount of treatment liquid applied to the recording medium.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 10 is an illustrative diagram showing the setting of coordinates inside a square lattice-shaped block;

FIG. 11 is an illustrative diagram showing the setting of coordinates inside a hexagonal lattice-shaped block;

DETAILED DESCRIPTION OF THE PREFERRED EMBODIMENTS

Figure 1:
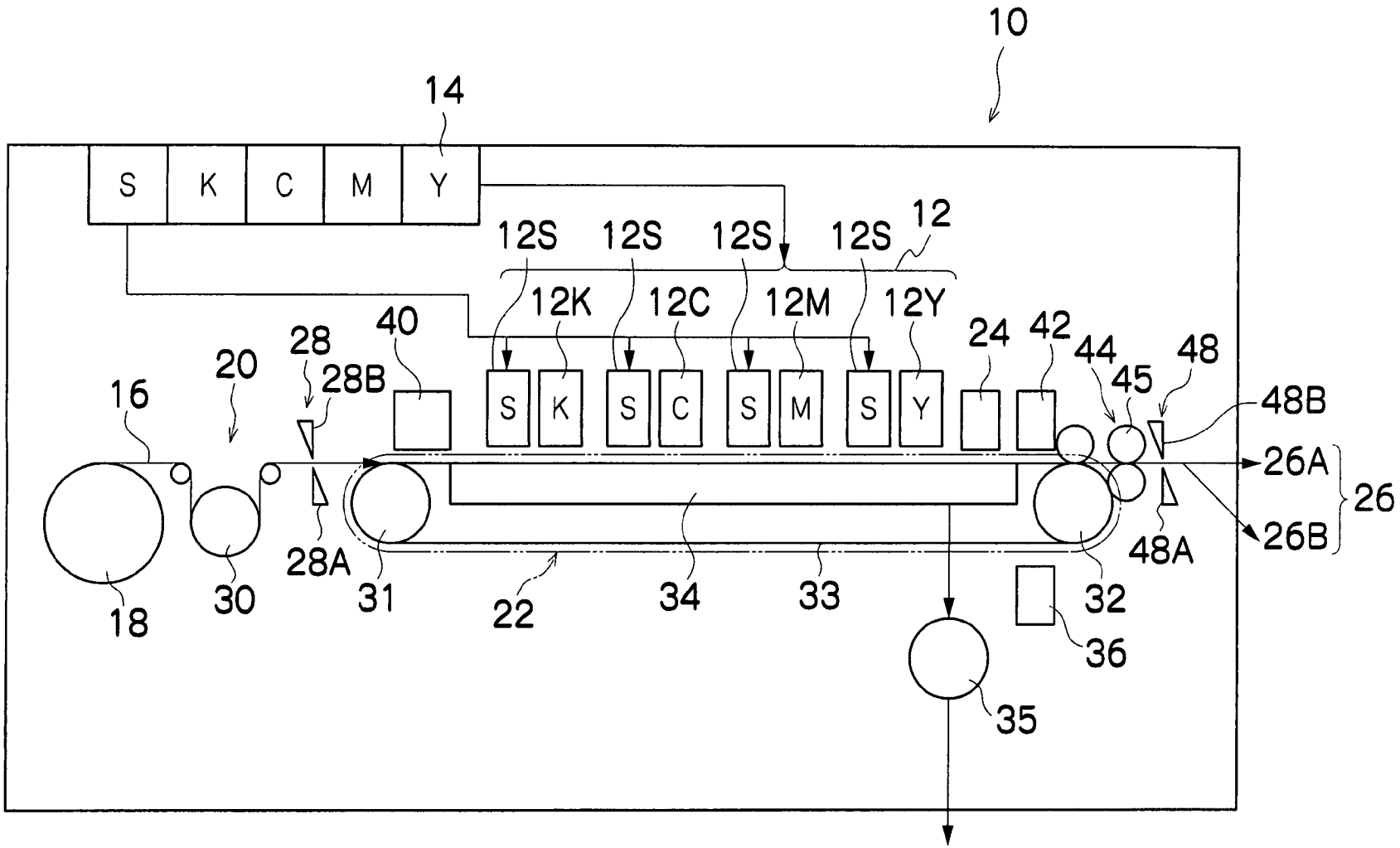
FIG. 1 is a general schematic drawing of one embodiment of an inkjet recording apparatus forming an image forming apparatus according to the present invention.

FIG. 1 is a general schematic drawing of an embodiment of an inkjet recording apparatus which forms an image forming apparatus relating to the present invention.

As shown in FIG. 1, this inkjet recording apparatus 10 is a two-liquid reaction type inkjet printer which prevents deposition interference between inks and bleeding of ink by mixing transparent treatment liquid and ink and thus causing the ink to solidify, or the like. The inkjet recording apparatus 10 has a print unit 12 comprising a plurality of print heads (ink application devices) 12K, 12C, 12M and 12Y provided respectively for the ink colors, and treatment liquid ejection heads (treatment liquid application devices) 12S disposed respectively immediately before the print heads 12K, 12C, 12M and 12Y.

In the example shown in FIG. 1, the treatment liquid ejection heads 12S are provided respectively for the print heads 12K, 12C, 12M and 12Y, but rather than providing a plurality of treatment liquid ejection heads 12S in this way, it is also possible to provide only one treatment liquid ejection head 12S, before all of the print heads 12K, 12C, 12M and 12Y.

Furthermore, the inkjet recording apparatus 10 also comprises: an ink storing and loading unit 14 for storing inks to be supplied to the print heads 12K, 12C, 12M, and 12Y and treatment liquid to be supplied to the treatment liquid ejection heads 12S; a paper supply unit 18 for supplying recording paper 16; a decurling unit 20 for removing curl in the recording paper 16; a belt conveyance unit 22 disposed facing the nozzle face (ink ejection face) of the print unit 12, for conveying the recording paper 16 while keeping the recording paper 16 flat; a print determination unit 24 for reading the printed result produced by the print unit 12; and a paper output unit 26 for outputting printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

There are no particular limitations on the structure of the belt conveyance unit 22, and it may use vacuum suction conveyance in which the recording paper 16 is conveyed by being suctioned onto the belt 33 by negative pressure created by suctioning air through suction holes provided on the belt surface, or it may be based on electrostatic attraction.

The belt 33 has a width dimension that is broader than the width of the recording paper 16, and in the case of the vacuum suction conveyance method described above, a plurality of suction holes (not shown) are formed in the surface of the belt. A suction chamber (not shown) is disposed in a position facing the sensor surface of the print determination unit 24 and the nozzle surface of the printing unit 12 on the interior side of the belt 33, which is set around the rollers 31 and 32, as shown in FIG. 1; and this suction chamber provides suction with a fan (not shown) to generate a negative pressure, thereby holding the recording paper 16 onto the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2:
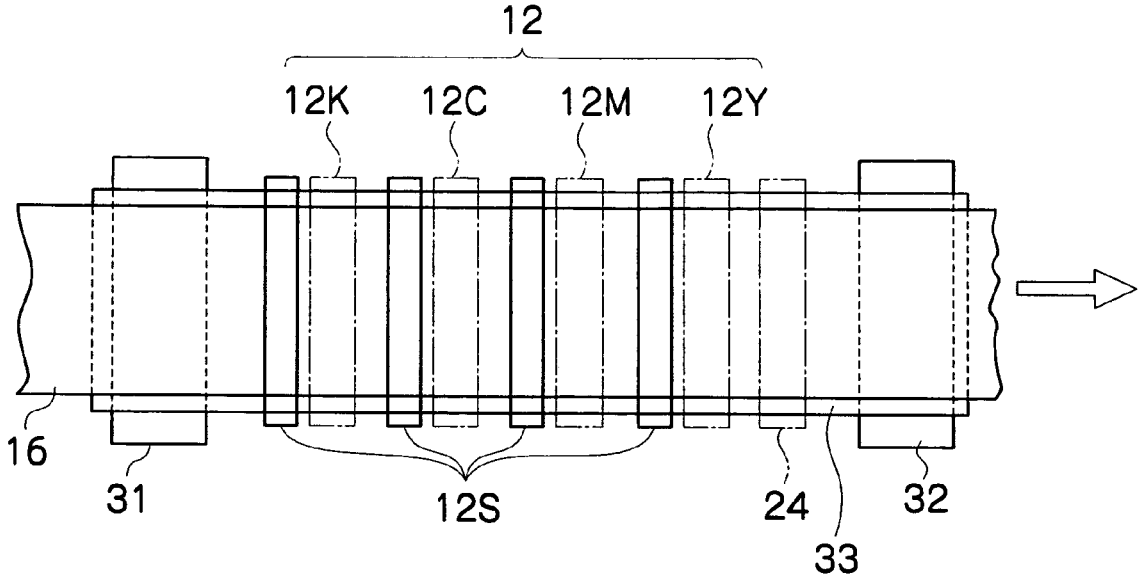
FIG. 2 is a plan view of the principal part of the peripheral area of a print unit in the inkjet recording apparatus shown in FIG. 1.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction; indicted by the arrow in the diagram).

The print heads 12K, 12C, 12M and 12Y are constituted by line heads in which a plurality of ink ejection ports (nozzles) are arranged through a length exceeding at least one side of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

Furthermore, the treatment liquid ejection head 12S, also having a length corresponding to the maximum paper width, is disposed in parallel to each of the print heads 12K, 12C, 12M and 12Y, on the upstream side of each of the print heads 12K, 12C, 12M and 12Y.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and a tank for storing treatment liquid for supplying to the treatment liquid ejection heads 12S, and the tanks are connected to a respective print head 12K, 12C, 12M, 12Y, or the treatment liquid ejection heads 12S, via tube channels (not shown). Moreover, the ink storing and loading unit 14 also comprises a notifying device (display device, alarm generating device, or the like) for generating a notification if the remaining amount of ink has become low, as well as having a mechanism for preventing incorrect loading of the wrong colored ink.

The print determination unit 24 has an image sensor (a line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although omitted from the drawing, a sorter for collating and stacking the images according to job orders is provided in the paper output section 26A corresponding to the main images.

Furthermore, in the inkjet recording apparatus 10, a cleaning unit 66 is provided for cleaning the print heads 12K, 12C, 12M and 12Y and the treatment liquid ejection heads 12S, on the downstream side of the belt 33 in a position corresponding to that of the print unit 12. The cleaning unit 66 is described in detail below.

Figure 3:
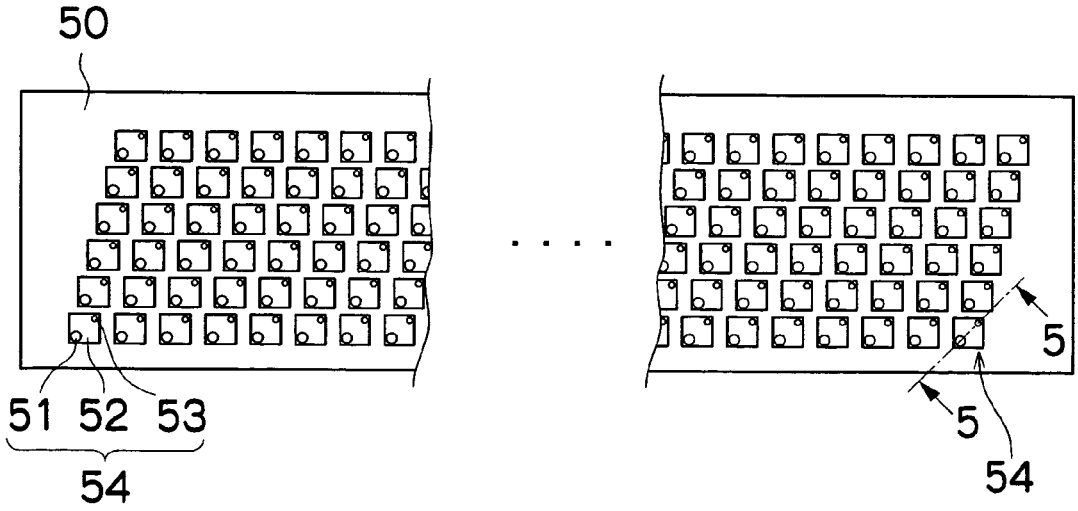
FIG. 3 is a plan perspective diagram showing an example of the structure of a print head.

Next, the arrangement of the nozzles in the print heads 12K, 12C, 12M and 12Y will be described. The print heads 12K, 12C, 12M and 12Y provided for the respective ink colors each have the same structure, and a print head forming a representative example of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle for ejecting ink as ink droplets, a pressure chamber 52 for applying pressure to the ink in order to eject ink, and an ink supply port 53 for supplying ink to the pressure chamber 52 from a liquid supply chamber (not shown in FIG. 3).

In the example shown in FIG. 3, the pressure chambers 52 each have an approximately square planar shape when viewed from above, but the planar shape of the pressure chambers 52 is not limited to a square shape. As shown in FIG. 3, a nozzle 51 is formed at one end of a diagonal of each pressure chamber 52, and an ink supply port 53 is provided at the other end thereof.

Furthermore, although not shown in the drawings, the treatment liquid ejection heads 12S also have a substantially similar composition to the print head 50, but as described hereinafter, since one droplet is treatment liquid is deposited onto a block constituted by a plurality of pixels, the number of nozzles ejecting treatment liquid is set so as to be fewer than the nozzles 51 formed in the print head 50.

Figure 4:
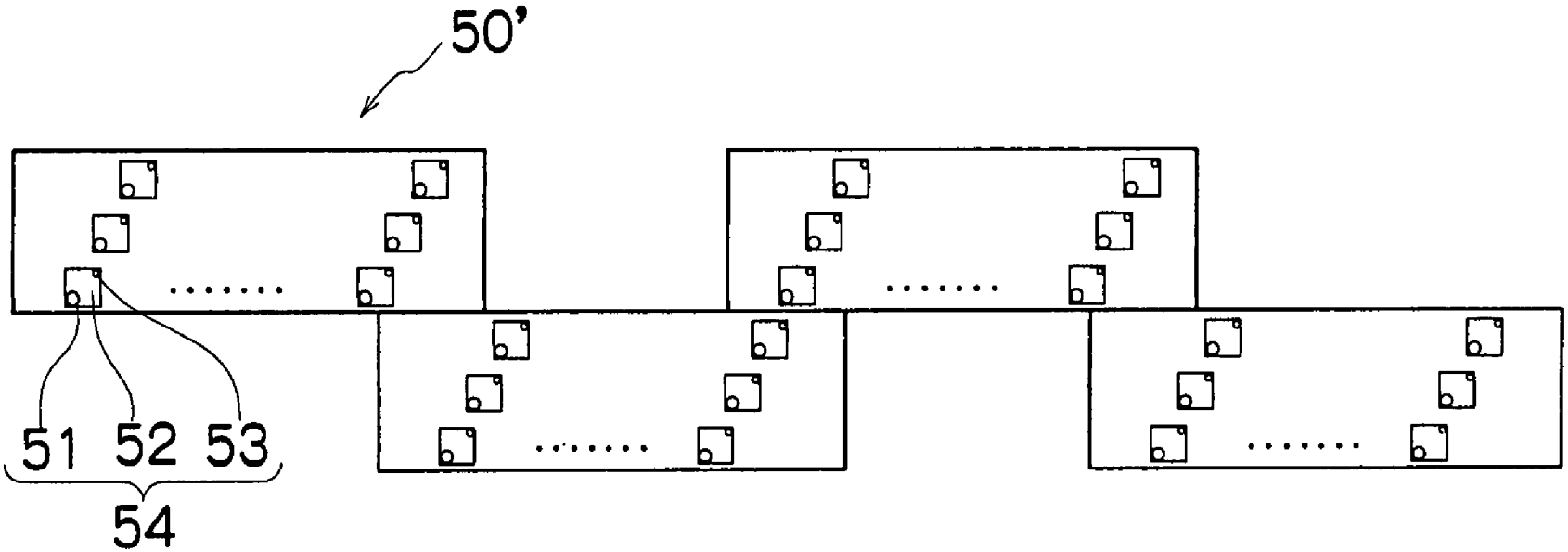
FIG. 4 is a plan view showing a further example of a print head.

Moreover, FIG. 4 is a plan view perspective diagram showing a further example of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
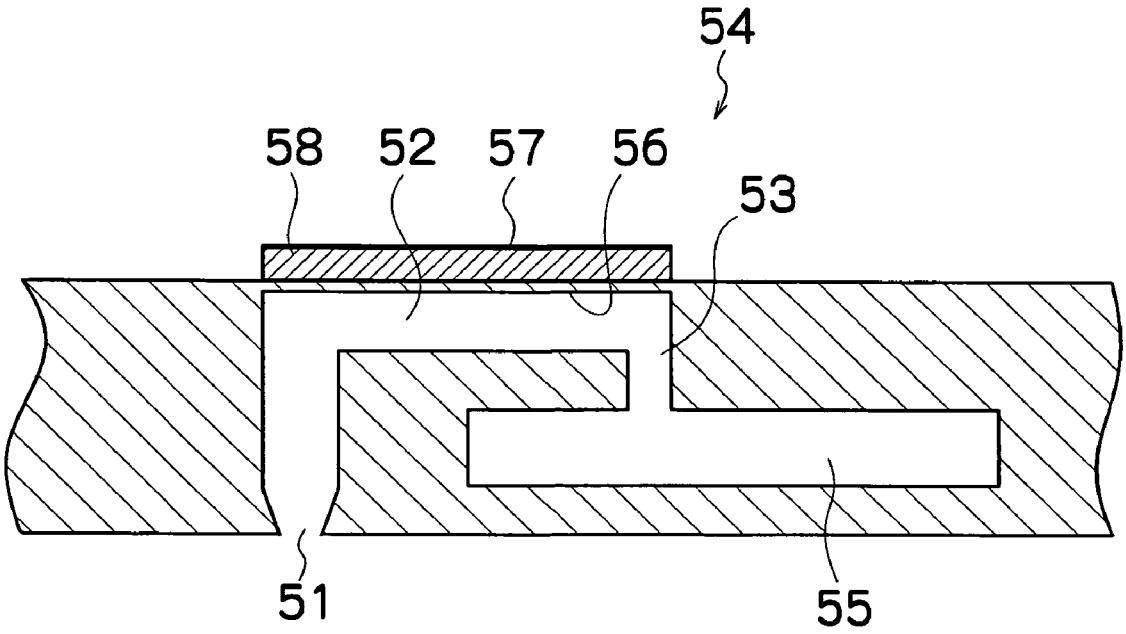
FIG. 5 shows a cross-sectional view of one pressure chamber unit along line 5-5 in FIG. 3.

Furthermore, FIG. 5 shows a cross-sectional diagram along line 5-5 in FIG. 3.

As shown in FIG. 5, each pressure chamber unit 54 is formed by a pressure chamber 52 which is connected to a nozzle 51 that ejects ink, a liquid supply chamber 55 for supplying ink via an ink supply port 53 is connected to the pressure chamber 52, and one surface of the pressure chamber 52 (the ceiling in the diagram) is constituted by a diaphragm 56. A piezoelectric element 58 which deforms the diaphragm 56 by applying pressure to the diaphragm 56 is bonded to the upper part of same, and an individual electrode 57 is formed on the upper surface of the piezoelectric element 58. Furthermore, the diaphragm 56 also serves as a common electrode.

The piezoelectric element 58 is sandwiched between the common electrode (diaphragm 56) and the individual electrode 57, and it deforms when a drive voltage is applied to these two electrodes 56 and 57. The diaphragm 56 is pressed by the deformation of the piezoelectric element 58, in such a manner that the volume of the pressure chamber 52 is reduced and ink is ejected from the nozzle 51. When the voltage applied between the two electrodes 56 and 57 is released, the piezoelectric element 58 returns to its original position, the volume of the pressure chamber 52 returns to its original size, and new ink is supplied into the pressure chamber 52 from the liquid supply chamber 55 and via the supply port 53.

Figure 6:
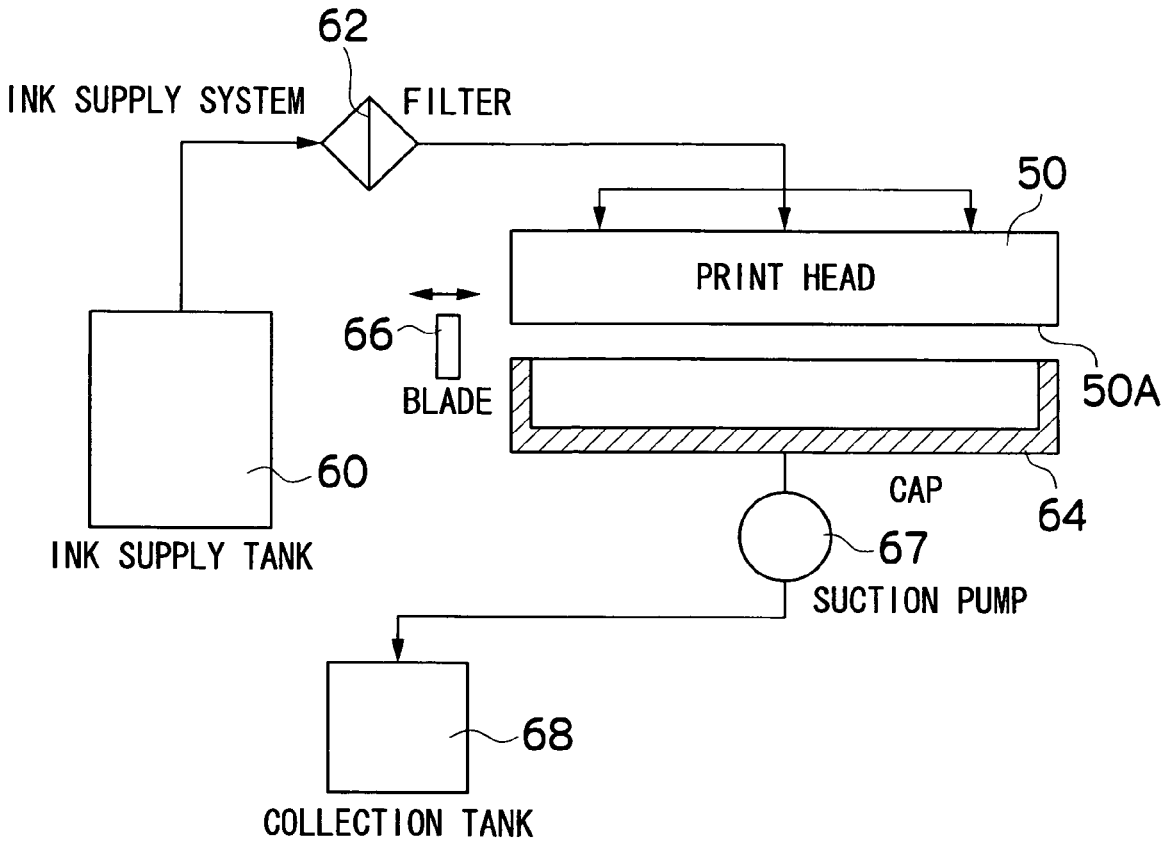
FIG. 6 is an approximate diagram showing the composition of an ink supply system in the inkjet recording apparatus.

FIG. 6 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

As shown in FIG. 6, a filter 62 for eliminating foreign material and air bubbles is provided at an intermediate position of the tubing which connects the ink tank 60 with the print head 50. Desirably, the filter mesh size is the same as the nozzle diameter in the print head 50, or smaller than the nozzle diameter (generally, about 20 μm).

Although not shown in FIG. 6, desirably, a composition is adopted in which a subsidiary tank is provided in the vicinity of the print head 50, or in an integrated manner with the print head 50. The subsidiary tank has the function of improving damping effects and refilling, in order to prevent variations in the internal pressure inside the head.

Furthermore, the inkjet recording apparatus 10 is also provided with a cap 64 as a device to prevent the nozzles 51 from drying out or to prevent an increase in the ink viscosity in the vicinity of the nozzles, and a cleaning blade 66 as a device to clean the nozzle surface 50A.

A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by suction is sent to a collection tank 68. This suction operation is also carried out in order to suction and remove degraded ink which has hardened due to increasing in viscosity when ink is loaded into the print head for the first time, and when the print head starts to be used after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the pressure generating devices (not shown, but described hereinafter) for driving ejection are operated. Therefore, before a state of this kind is reached (while the ink is in a range of viscosity which allows ink to be ejected by means of operation of the pressure generating devices), a "preliminary ejection" is carried out, whereby the pressure generating devices are operated and the ink in the vicinity of the nozzles, which is of raised viscosity, is ejected toward the ink receptacle. Furthermore, after cleaning away soiling on the surface of the nozzle surface 50A by means of a wiper, such as a cleaning blade 66, provided as a cleaning device on the nozzle surface 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed into the ink inside the nozzles 51 and the pressure chambers 52, ink can no longer be ejected from the nozzles even if the laminated pressure generating devices are operated. In a case of this kind, a cap 64 is placed on the nozzle surface 50A of the print head 50, and the ink containing air bubbles or the ink of increased viscosity inside the pressure chambers 52 is suctioned by a pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 shown in FIG. 6 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 7:
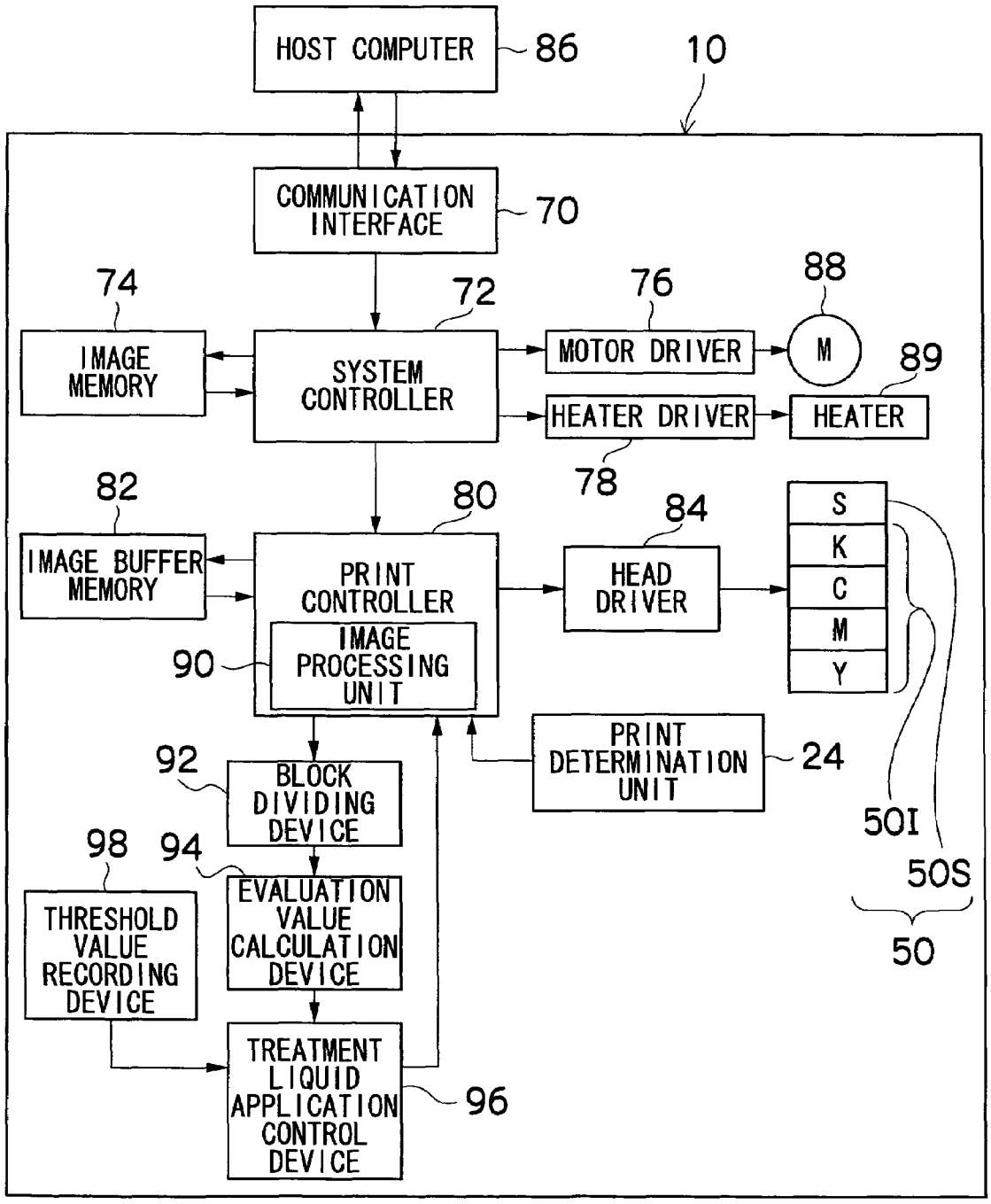
FIG. 7 is a principal block diagram showing the system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communication interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with instructions from the system controller 72. The heater driver 78 drives the heater 89 of the post-drying unit 42 or the like in accordance with commands from the system controller 72.

The print controller 80 comprises an image processing unit 90 which performs image processing, such as error diffusion, or the like, and it is a control unit having a signal processing function for performing various treatment processes, corrections, and the like, in accordance with the control implemented by the system controller 72, in order to generate a signal for controlling printing from the image data in the image memory 74. The print controller 80 supplies the print control signal (print data) thus generated to the head driver 84.

Prescribed signal processing is carried out in the print controller 80, and the ejection amount and the ejection timing of the liquid droplets from the ink ejection heads 50I, which are the ink application devices, and the treatment liquid ejection heads 50S, which are the treatment liquid application devices, are controlled via the head driver 84, on the basis of the image data. The image buffer memory 82 is provided in the print controller 80, and image data, parameters, and other data are temporarily stored in the image buffer memory 82 when image data is processed in the print controller 80.

The present embodiment relates to a two-liquid reaction type inkjet printer which mixes a transparent treatment liquid and ink, in such a manner that the ink is increased in viscosity or caused to solidify by reaction of the two liquids, thereby preventing deposition interference of the ink and ink bleeding, wherein the image region on the recording medium is divided into a plurality of blocks, a prescribed evaluation value is calculated for each block on the basis of the image data, the evaluation value is compared with a threshold value previously stored in the apparatus, and the mode of application of the treatment liquid onto the respective blocks is controlled in such a manner that the treatment liquid is deposited (applied) to the block in accordance with the comparison results.

Therefore, the print controller 80 also comprises a block dividing device 92, an evaluation value calculation device 94, a treatment liquid application control device 96, and a threshold value recording device 98.

The image processing unit 90 performs suitable image processing, such as error diffusion or the like, with respect to the input image, prior to the ejection of ink droplets onto the recording paper 16, and creates, for each pixel and each color in the output data, a binarized data value which determines whether a dot is to be ejected or not to be ejected, or in a case where the size of the dot can be adjusted, then a data value based on a (N+1) value system, where N is the number of sizes which can be deposited (for example, a large size, medium size, small size, and the like).

The block dividing device 92 receives processed image data from the image processing unit 90 and divides the print region on the recording paper 16 into a block, where one block is formed by a group of several pixels. The method of dividing the image region into blocks is not limited in particular, but the respective blocks may be divided into a square lattice shape, or into a hexagonal lattice shape.

Figure 8:
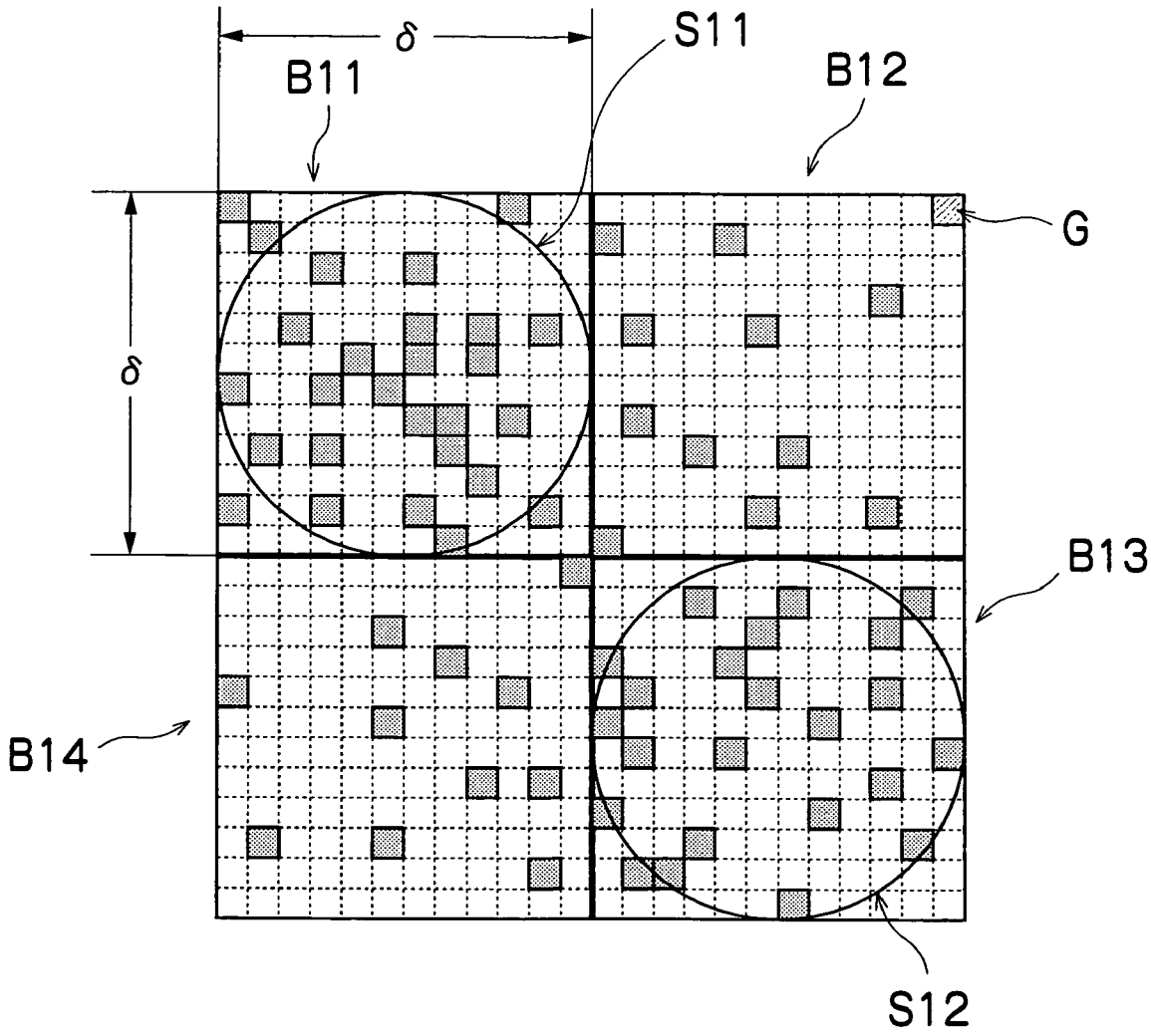
FIG. 8 is an illustrative diagram showing an example in which the image region is divided into square lattice-shaped blocks.

FIG. 8 shows an example where the blocks are divided in a square lattice shape. In the example shown in FIG. 8, the image region is divided into four blocks B11, B12, B13 and B14, which have a square lattice shape. In FIG. 8, the small square grid boxes G each depict one pixel: a black square indicates a position where an ink droplet is deposited and a white square indicates a position where no ink droplet is deposited.

Figure 9:
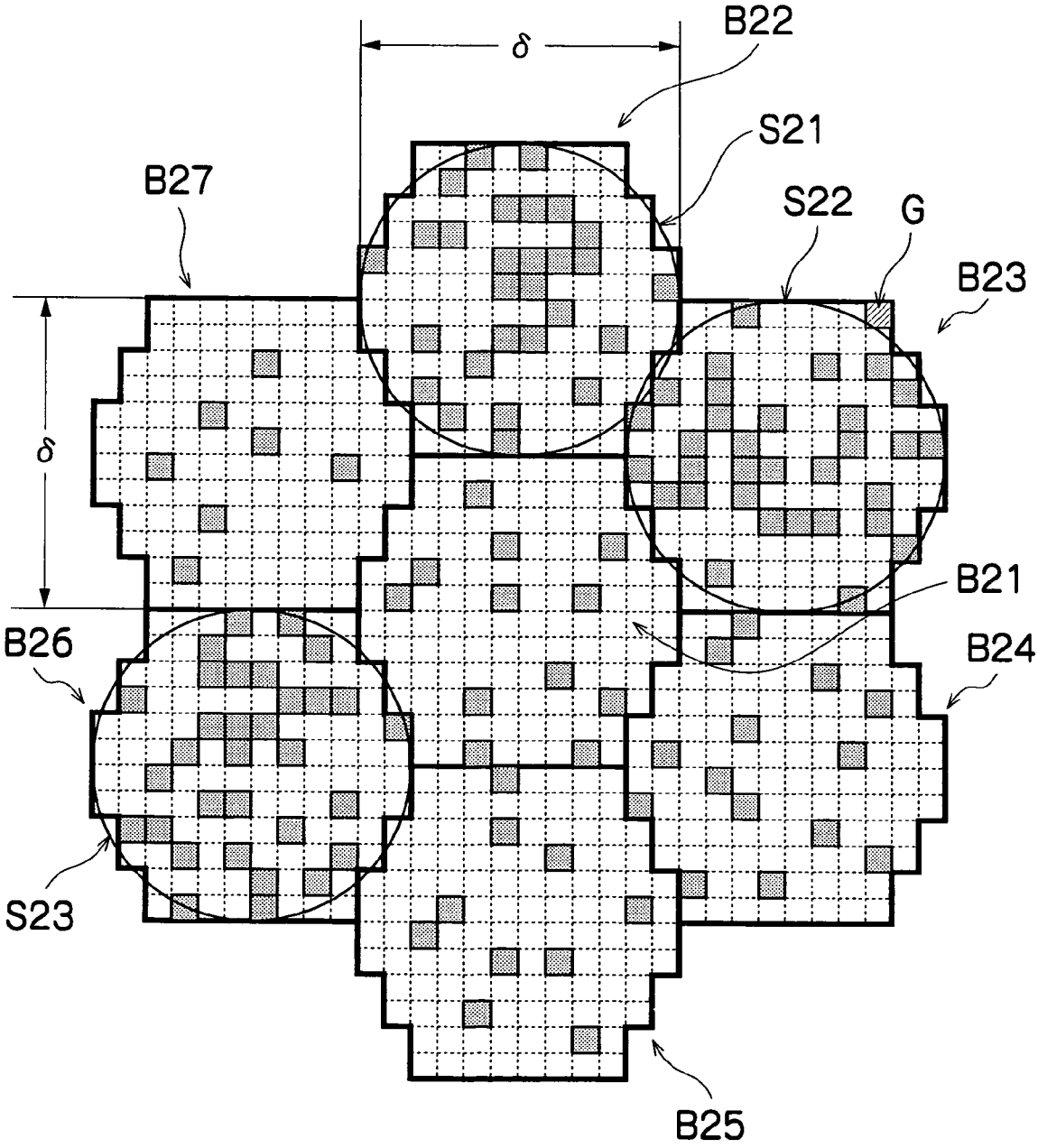
FIG. 9 is an illustrative diagram showing an example in which the image region is divided into hexagonal lattice-shaped blocks.

Furthermore, FIG. 9 shows an example of blocks divided in a substantially hexagonal lattice shape. In the example shown in FIG. 9, the image region is divided in such a manner that substantially hexagonal lattice-shaped blocks B22, B23, B24, B25, B26 and B27 are disposed respectively about a central block B21 which also has a hexagonal lattice shape.

Here, the transparent treatment liquid spreads in a substantially circular shape when deposited onto the recording medium 16, and taking account of human visual characteristics, a method which divides the blocks into a hexagonal lattice shape as shown in FIG. 9 is more desirable than one which divides the blocks into a square lattice shape as shown in FIG. 8.

Furthermore, in FIG. 8 and FIG. 9, a position where an ink droplet is deposited is represented by a black square (grid box) G, but in practice, the dots spread respectively in a substantially circular shape and their diameters are greater than the distance between respective pixels. Therefore, mutually adjacent dots overlap with each other. Furthermore, in FIG. 8 and FIG. 9, desirably, taking account of human visual characteristics, the length δ of the largest edge of each block is equal to or less than approximately 150 μm.

The evaluation value calculation device 94 counts the number of dots to be deposited in each of the respective blocks divided as described above, and an evaluation value for judging whether or not treatment liquid is to be deposited is calculated, by taking account of prescribed conditions which are described below.

In order to count the dots in each block, coordinates for indicating the pixels are applied to the pixels in each block in the following manner. In other words, in the case of square lattice-shaped blocks as shown in FIG. 8, in each of the blocks B11, B12, B13 and B14, the upper left-most pixel of the block is set as (0, 0) as shown in FIG. 10, and coordinates are applied to each pixel, in such a manner that the coordinate value increases in the rightward direction, taking the main scanning direction as the direction of the horizontal axis, and the coordinate value increases in the downward direction, taking the sub-scanning direction as the direction of the vertical axis. In FIG. 10, a general rectangular-shaped lattice is depicted in such a manner that Nx pixels are arranged in the direction of the horizontal axis and Ny pixels are arranged in the direction of the vertical axis. However, in the square lattice shown in FIG. 8, then Nx=Ny.

Furthermore, in the hexagonal lattice-shaped blocks shown in FIG. 9, the coordinates are applied as shown in FIG. 11, for example. More specifically, in FIG. 11, the number of the starting pixel in the main scanning direction of the i-th row (from the top) in the sub-scanning direction (vertical axis direction) is taken to be M(i) and the number of the final pixel of this row in the main scanning direction is taken to be N(i). Accordingly, the left-most pixel of the first row of the sub-scanning direction (the 0-th row, in other words, the uppermost row) is (M(0), 0); the pixel adjacent to this pixel on the right-hand side is (M(0)+1, 0), and the final pixel of the row is (N(0), 0).

Furthermore, the next row in the sub-scanning direction (the first row, in other words, the second row from the top) starts from the left-most pixel (M(1),1), and ends at the right-most pixel (N(1),1). Thereafter, similarly, the lowermost row in the sub-scanning direction (the Ny-th row from the top) starts at pixel (M(Ny−1), Ny−1), and ends at pixel (N(Ny−1), Ny−1).

The evaluation value calculation device 94 and the treatment liquid application control device 96 carry out processing by using the coordinates of the respective pixels applied in this fashion.

The treatment liquid application control device 96 compares the evaluation value calculated above with a threshold value recorded previously in the threshold value recording device 98, and judges whether or not droplets of treatment liquid are to be deposited (applied), respectively for each block. It then sends a control signal indicating whether or not to deposit droplets of treatment liquid to the head driver 84 via the print controller 80, and hence the treatment liquid application mode is controlled respectively for each block.

Here, when the transparent treatment liquid is to be deposited onto the blocks in accordance with the judgment of the treatment liquid application control device 96, then it is possible to eject a plurality of droplets of treatment liquid onto the respective blocks, using a regular pattern. However, from the viewpoint of reducing the number of treatment liquid ejection nozzles, reducing the treatment liquid ejection frequency, lowering the control load, and the like, it is desirable to deposit one droplet of treatment liquid having substantially the same size as the blocks, within each respective block.

For example, in the example shown in FIG. 8, circular dots of treatment liquid S11 and S12 having substantially the same size as the blocks are deposited respectively onto block B11 and block B13. In the example shown in FIG. 9, circular dots of treatment liquid S21, S22 and S23 having substantially the same size as the blocks are deposited respectively onto the blocks B22, B23, and B26.

After ejecting treatment liquid from the treatment liquid ejection head 12S, ink of the different colors is ejected respectively from the print heads 12K, 12C, 12M and 12Y, thus forming an image. In this way, the treatment liquid reacts with the ink of the respective colors, the ink increases in viscosity or solidifies, and therefore deposition interference of the ink or bleeding of the ink is prevented.

In FIG. 7, the image buffer memory 82 is depicted as being attached to the print controller 80; however, the image memory 74 may also serve as the image buffer memory 82. Also possible is a mode in which the print controller 80 and the system controller 72 are integrated to form a single processor.

The head driver 84 drives the pressure generating devices of the print heads 50 of the respective colors, on the basis of the print data supplied from the print controller 80. A feedback control system for maintaining constant drive conditions for the print heads may be included in the head driver 84.

As shown in FIG. 1, the print determination unit 24 is a block including a line sensor (not shown), which reads in the image printed onto the recording paper 16, performs various signal processing operations, and the like, and determines the print situation (presence/absence of ejection, variation in droplet ejection, and the like). The print determination unit 24 supplies these detection results to the print controller 80.

Furthermore, according to requirements, the print controller 80 makes various corrections with respect to the print head 50 on the basis of information obtained from the print determination unit 24.

Next, before describing the action of the present embodiment, the control of the treatment liquid application mode according to a related art described above, will be described with reference to a flowchart, in order to clarify the characteristic features of the present invention by comparison with same.

Figure 16:
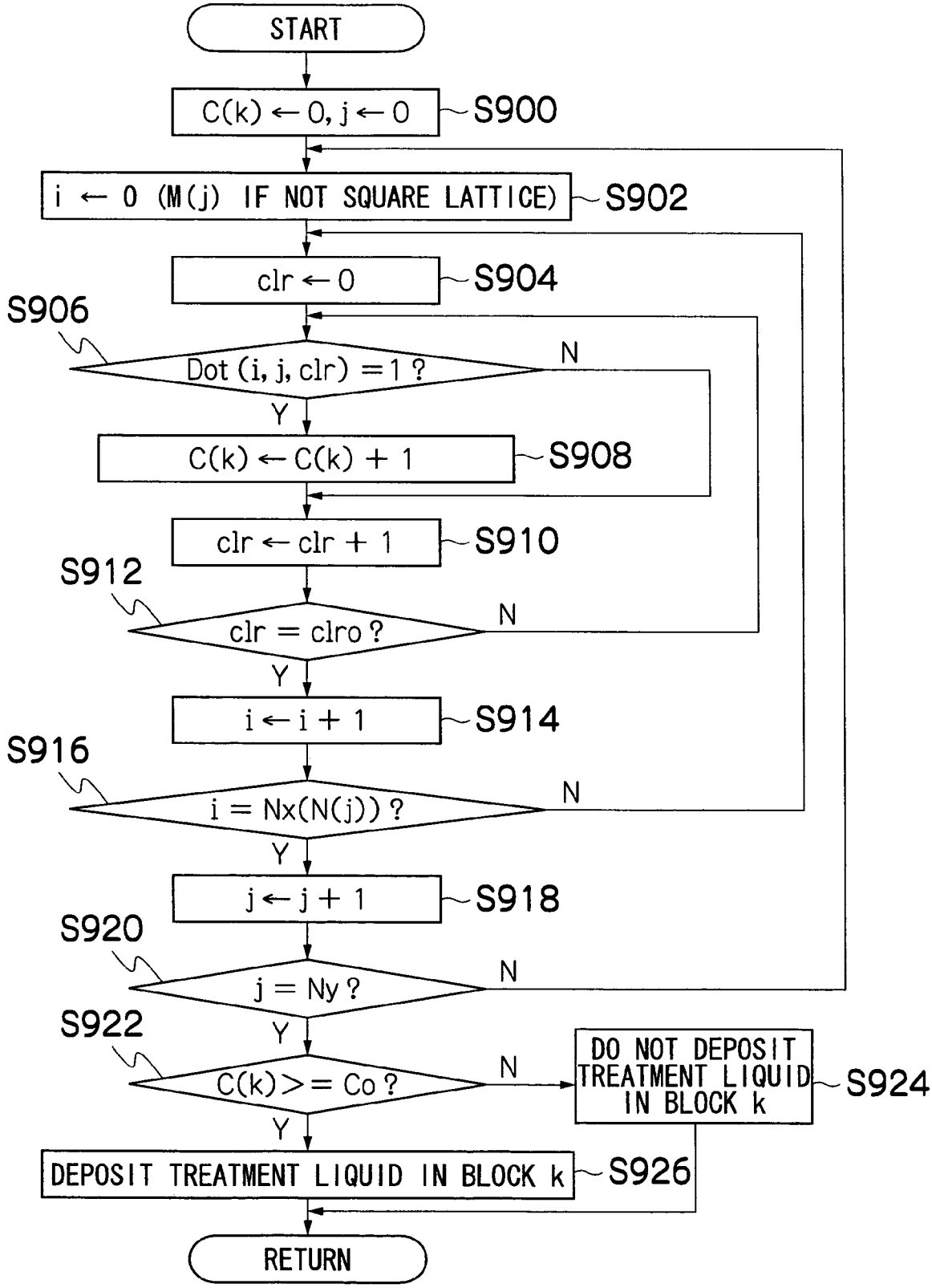
FIG. 16 is a flowchart showing a treatment liquid application control method according to a related art.

FIG. 16 is a flowchart showing a treatment liquid droplet ejection control method according to the related art. Stated simply, this method involves dividing the image region into blocks, counting the number of dots to be deposited for each block, comparing this number with a threshold value, and judging whether or not to deposit droplets of treatment liquid onto the blocks.

Firstly, at step S900, the dot deposition number counter C(k) for the block which is currently to be processed (the k-th block), is cleared to zero, and the j coordinate in the sub-scanning direction in the block is set to 0.

Next, at step S902, an initial value is substituted for the i coordinate in the main scanning direction in the j-th row in the sub-scanning direction (where, initially, j=0). In this case, if the blocks are square lattice-shaped blocks as shown in FIG. 8, then 0 is substituted for i, and if the blocks are other than square lattice-shape blocks, such as the hexagonal lattice-shaped blocks shown in FIG. 9, the coordinate M(j) indicating the start pixel in the main scanning direction of the j-th row in the sub-scanning direction is substituted.

Next, at step S904, a value 0 indicating the initial color is substituted for the index clr which indicates the ink color. There are no particular limitations on this value, and in a case where there are four colors, for example, correspondences between respective values and colors are previously determined, in such a manner that, for instance, the color is cyan when clr=0, magenta when clr=1, yellow when clr=2, and black when clr=3.

Next, at step S906, it is judged whether or not an ink dot of the color clr is to be deposited at the pixel position (i, j), by looking at the indicator Dot (i, j, clr) which indicates whether or not a droplet of ink of the color clr is to be deposited at the pixel position (i, j), as determined already in the image processing stage. Here, for example, it is previously specified that when the value of the indicator Dot (i, j, clr) is 1, then a dot is deposited, and when it is 0, then no dot is deposited.

If the value of the indicator Dot (i, j, clr) is 1, then at the next step S908, the value of the dot number counter C(k) is incremented by 1, whereas if the value of the indicator Dot (i, j, clr) is 0, then the value of the dot number counter C(k) is left unchanged. The process then moves on to step S910, where the index clr which indicates the ink color is incremented by 1.

At step S912, it is judged whether or not the ink color index clr has reached the number of ink colors, clr0, used in this case. If there are four colors as described above, then the number of colors, clr0, has a value of 4. If, on the basis of this judgment, the aforementioned processing has not yet been completed for all of the colors, the procedure returns to step S906 and processing is carried out for the next color.

If the processing has been completed for all of the colors, then in the next step S914, the i coordinate in the main scanning direction is increased by one and the next pixel in the j-th row in the sub-scanning direction is processed. In step S916, the i coordinate in the main scanning direction is compared with the coordinate of the final pixel in that row. In this case, if the blocks have a square lattice shape, then the coordinate in the main scanning direction of the final pixel in the sub-scanning direction j is Nx, and if the blocks do not have a square lattice shape, then the coordinate of the final pixel is N(j).

If the i coordinate in the main scanning direction has not yet reached that of the final pixel, then the procedure returns to the step S904 and processing similar to that described above is continued. Furthermore, if the coordinate value has reached the final pixel in the main scanning direction, then at the next step, S918, the j coordinate in the sub-scanning direction is incremented by 1, and it is then judged at step S920 whether or not the final row Ny in the sub-scanning direction has been reached. If the final value Ny has not been reached, then the procedure returns to step S902 and the aforementioned processing is repeated.

Moreover, if the final row Ny in the sub-scanning direction has been reached, the count of the number of dots for that block is taken to have ended, and hence, at the next step, S922, the dot number C(k) counted thus far is compared with a previously established threshold value C0. If the counted number of dots C(k) does not exceed the threshold value C0, then as shown in step S924, no droplets of transparent treatment liquid are deposited for the k-th block. If the counted number of dots C(k) does exceed the threshold value C0, then at step S926, a droplet of transparent treatment liquid is deposited onto the block k.

When the treatment liquid droplet deposition process for the k-th block has been completed as described above, the procedure returns to the start of the flowchart, the value of k is changed to the next k value, and processing for the next block is carried out.

In this way, the method uses extremely simple judgment conditions which merely compare the counted number of dots with a threshold value, and therefore, there is a problem in that suitable judgment cannot be made in order to prevent image deterioration caused by deposition interference, bleeding into ordinary paper, bleeding between colors, and the like.

On the other hand, in the present invention, rather than simply counting the number of dots inside a block, as described hereinafter, an evaluation value which corresponds to the prescribed conditions is calculated from the counted dot number, and it is judged whether or not to deposit droplets of treatment liquid on the basis of this evaluation value.

Below, an embodiment of the present embodiment will be described.

Firstly, a description is given of a treatment liquid application control method relating to the first embodiment for judging how to deposit droplets of transparent treatment liquid onto the respective blocks in accordance with the image data. The first embodiment calculates an evaluation value in such a manner that, when the number of ink dots in each block is counted, the counted value is varied in accordance with the size of the dots.

Figure 12:
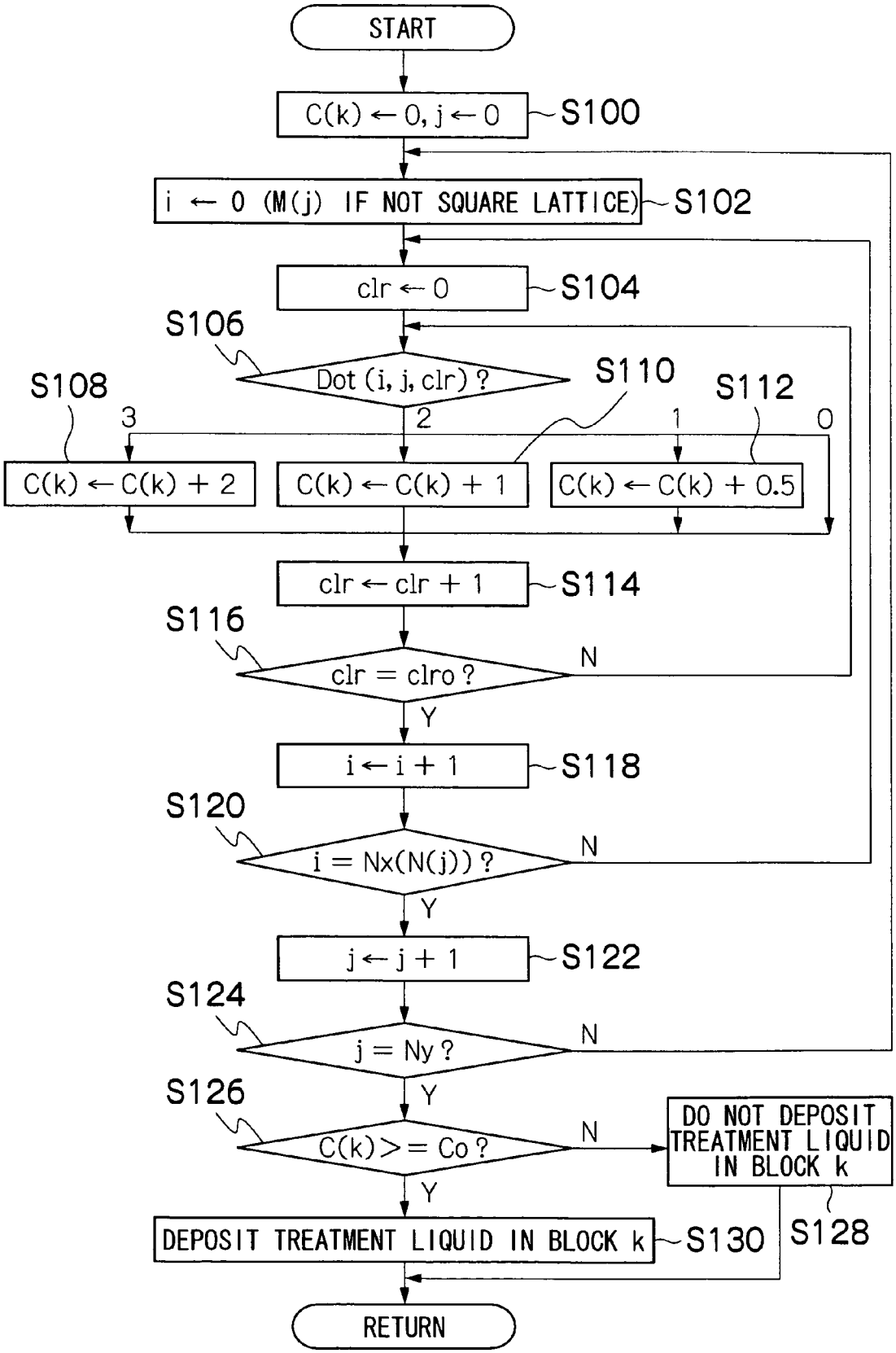
FIG. 12 is a flowchart showing a treatment liquid application control method according to the first embodiment of the present invention.

FIG. 12 shows a flowchart of a treatment liquid application control method relating to a first embodiment.

The description below follows the flowchart shown in FIG. 12. The processing shown in this flowchart is implemented principally by the evaluation value calculation device 94 and the treatment liquid application control device 96, following the processing performed by the image processing unit 90 and the block dividing device 92.

Firstly, at step S100, the dot deposition number counter C(k) for the block which is currently to be processed (the k-th block), is cleared to zero, and the j coordinate in the sub-scanning direction in the block is set to 0.

Next, at step S102, an initial value is substituted for the i coordinate in the main scanning direction in the j-th row in the sub-scanning direction (where, initially, j=0). In this case, if the blocks are square lattice-shaped blocks as shown in FIG. 8, then 0 is substituted for i, and if the blocks are other than square lattice-shape blocks, such as the hexagonal lattice-shaped blocks shown in FIG. 9, the coordinate M(j) indicating the start pixel in the main scanning direction of the j-th row in the sub-scanning direction is substituted for i.

Next, at step S104, a value 0 indicating the initial color is substituted for the index clr which indicates the ink color. The ink color index clr is previously set for each of the colors, in such a manner that, for example, clr=0 for cyan, clr=1 for magenta, clr=2 for yellow, and clr=3 for black.

Next, at step S106, the value of the indicator Dot (i, j, clr) which indicates the ink droplet deposition state for the color clr set at each pixel position (i, j) in the block, as determined by the image processing unit 90 in the ink processing stage, is evaluated. This indicator Dot (i, j, clr) shows what size of dot is to be deposited (or whether no droplet is to be deposited) of the ink of color clr, at the pixel position (i, j).

In the case of the method described above, this indicator Dot (i, j, clr) is based on a simple two-way judgment indicating whether or not a droplet is to be deposited, but in the present embodiment, the value of this indicator Dot (i, j, clr) can be set to one of four values: for instance, if Dot (i, j, clr)=3, then a large dot of ink of color clr is to be deposited at the pixel position (i, j); if Dot (i, j, clr)=2, then a medium dot of ink of color clr is to be deposited at the pixel position (i, j); if Dot (i, j, clr)=1, then a small dot of ink of color clr is to be deposited at the pixel position (i, j); and if Dot (i, j, clr)=0, then no dot of ink of color clr is to be deposited at pixel position (i, j). In this way, the application of the treatment liquid can be controlled finely.

If the indicator Dot (i, j, clr)=3 on the basis of this judgment, then at step S108, 2 is added to the dot deposition number counter C(k). Furthermore, if the indicator Dot (i, j, clr)=2, then at step S110, 1 is added to the dot deposition number counter C(k). Furthermore, if the indicator Dot (i, j, clr)=1, then at step S112, 0.5 is added to the dot deposition number counter C(k). Moreover, if indicator Dot (i, j, clr)=0, then the value of C(k) is left unchanged and the procedure advances to step S114.

At the next step, S114, the index clr indicating the ink color is incremented by 1 and the procedure advances to processing for the next color. At step S116, it is judged whether or not this ink color index clr has reached the number of colors used, clr0 (if there are four colors as in the present embodiment, then clr0=4), and if processing has not yet been completed for all of the ink colors, the procedure returns to step S106 and the aforementioned processing is repeated.

Furthermore, if the ink color index clr has become equal to clr0, and processing has been completed for all of the ink colors, then at the next step, S118, the i coordinate indicating the pixel position in the main scanning direction is incremented by 1, and the procedure transfers to processing of the next pixel in the main scanning direction of the j-th row in the sub-scanning direction.

In the next step, S120, it is judged whether or not all of the processing in the main scanning direction has been completed for the j-th row in the sub-scanning direction. In other words, it is judged whether or not the i coordinate in the main scanning direction is equal to the coordinate of the final pixel in that row. If the blocks have a square lattice shape, then this is done by comparing the i coordinate with the final coordinate Nx, and if the blocks have a shape other than a square lattice shape, such as a hexagonal lattice shape, then this is done by comparing with the final coordinate N(j).

Consequently, if processing has not yet been completed for all of the pixels arranged in the main scanning direction in the j-th row in the sub-scanning direction, then the procedure returns to step S104 and the aforementioned processing is repeated. Furthermore, if processing has been completed for the j-th row in the sub-scanning direction, then at step S122, the number j in the sub-scanning direction is incremented by 1, and the procedure transfers to processing of the next row in the sub-scanning direction.

At the next step, S124, it is judged whether or not all of the processing has been completed in the sub-scanning direction, and if all of the processing has not yet been completed, then the procedure returns to step S102 and the aforementioned processing is repeated. Moreover, if all of the processing has been completed in the sub-scanning direction, then at the next step S126, the value indicated by the dot deposition number counter C(k) that has been summed thus far (the evaluation value) is compared with a threshold value C0 set previously in the threshold value recording device 98.

If, as a result of this, the value of the counter C(k) forming the evaluation value is smaller than the threshold value C0, then at step S128, no droplets of transparent treatment liquid are deposited onto this block k. On the other hand, if the value of the counter C(k) forming the evaluation value is equal to or greater than the threshold value C0, then in the following step S130, a droplet of transparent treatment liquid is deposited onto the block k and processing for the k-th block is terminated.

Thereupon, the k value is changed, and processing for the next block is carried out again in line with the flowchart in FIG. 12, similarly to the foregoing. This processing is performed for all of the divided blocks, and hence transparent treatment liquid is deposited in an effective manner, and a high-quality image which prevents deposition interference of the ink or ink bleeding is formed.

Next, a treatment liquid application control method relating to a second embodiment of the present invention will be described. In the present embodiment, when the dot deposition number is counted, weighting is given to cases where ink dots of the same color are mutually adjacent.

Figure 13:
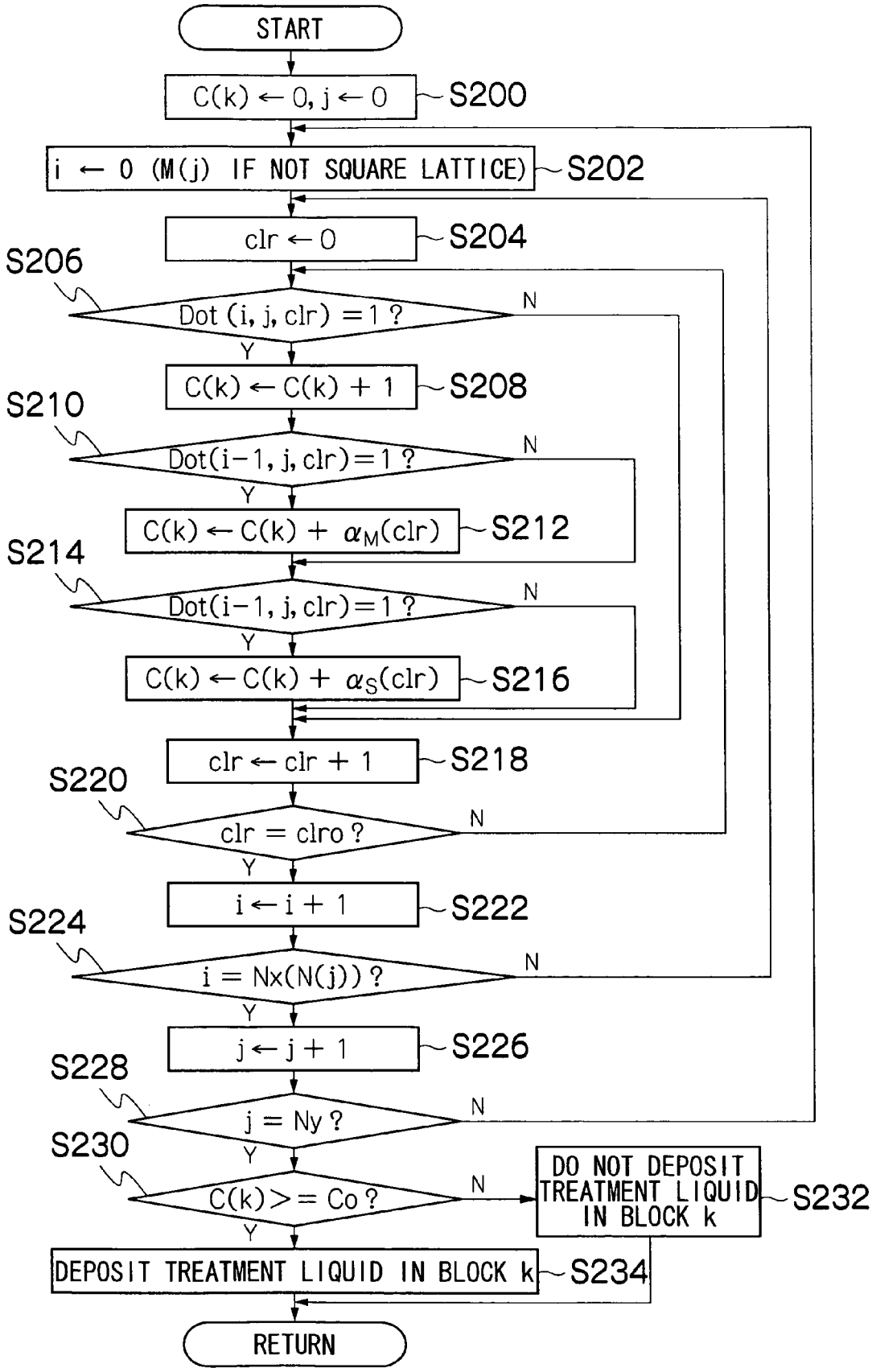
FIG. 13 is a flowchart showing a treatment liquid application control method according to the second embodiment of the present invention.

FIG. 13 shows a processing sequence of the present embodiment in the form of a flowchart, and below, this sequence is described with reference to the flowchart.

Firstly, at step S200, the dot deposition number counter C(k) and the j coordinate in the sub-scanning direction are respectively initialized (substituted with a value of 0), and at step S202, the i coordinate in the main scanning direction is initialized (in the case of a square lattice, it is set to 0; and in other cases, it is substituted with M(j)). Moreover, at step S204, the index clr indicating the ink color is initialized (substituted with a value of 0). Up to this point, the processing is similar to that of the first embodiment described above.

The processing from the next step S206 until step S216 differs from that of the first embodiment, described above, and is a section in which processing is carried out for incrementing the dot deposition number counter C(k) by applying a weighting when dots of the same color are mutually adjacent.

At step S206, it is judged whether or not a droplet of ink of ink color clr is to be deposited onto the position of coordinates (i, j), (in other words, whether or not Dot (i, j, clr)=1). If, as a result, no droplet is to be deposited, then the procedure skips all of the subsequent processing until step S216 and advances to step S218. If, on the other hand, a droplet of ink of the color clr is to be deposited onto the position of coordinates (i, j), then at the next step, S208, the counter C(k) is incremented by 1.

Next, at step S210, it is judged whether or not an ink dot of the same color, clr, is to be deposited at a mutually adjacent position (i−1, j) which is one position before in the main scanning direction with respect to coordinates (i, j) (in other words, whether or not Dot (i−1, j, clr)=1). If no such droplet is to be deposited, then the procedure skips the next step S212 and advances to step S214.

If, on the other hand, an ink dot of the same color is to be deposited at one position before in the main scanning direction, then at the next step, S212, a weighting value $\alpha_M$(clr) for mutual adjacency of the color clr in the main scanning direction is added to the counter C(k).

Next, at step S214, it is judged whether or not an ink droplet of the same color, clr, is to be deposited at a mutually adjacent position (i, j−1) which is one position before in the sub-scanning direction with respect to coordinates (i, j) (in other words, whether or not Dot (i, j−1, clr)=1).

If, as a result, no ink droplet of the same color is to be deposited at an adjacent position in the sub-scanning direction, then the procedure skips the next step S216 and advances to step S218. If, on the other hand, an ink droplet of the same color is to be deposited at an adjacent position in the sub-scanning direction, then in the next step, S216, the weighting value $\alpha_S$(clr) for adjacency of the color clr in the sub-scanning direction is added to the counter C(k).

At the next step, S218, the index clr indicating the ink color is incremented by 1 and the procedure transfers to processing for the next color. The subsequent processing is similar to that of the first embodiment described above, and therefore, detailed description thereof is omitted here.

In step S210 and step S214, if the coordinate i−1 or j−1 is equal to −1, then this means that the position is outside the coordinates of that block, and therefore, the corresponding pixel is the final (end) pixel of the block previous to this block k.

Furthermore, in respect of the weighting values $\alpha_S$(clr) and $\alpha_M$(clr), there are the three cases indicated in (1) to (3) below, depending on the degree of image deterioration due to deposition interference.

(1) Same values adopted for the main scanning direction and the sub-scanning direction. In other words, $\alpha_S(\text{clr})=\alpha_M(\text{clr})$.

(2) Larger a value in case of adjacency in the sub-scanning direction than in the case of adjacency in the main scanning direction. In other words, $\alpha_S(\text{clr})>\alpha_M(\text{clr})$. This is because when recording an image on the whole surface of the recording paper by means of one sub-scanning action, using a full line head which corresponds to the maximum width of the recording paper, the landing time interval is shorter in the case of dots which are mutually adjacent in the sub-scanning direction, than dots which are mutually adjacent in the main scanning direction.

(3) Larger α value in case of adjacency in the main scanning direction than in the case of adjacency in the sub-scanning direction. In other words, $\alpha_S(\text{clr})<\alpha_M(\text{clr})$. This is because when recording an image on the whole surface of the recording paper by means of one sub-scanning action, using a full line head which corresponds to the maximum width of the recording paper, banding parallel to the sub-scanning direction is the main cause of image deterioration.

The weighting values, $\alpha_S$(clr) and $\alpha_M$(clr), may be set independently of the color.

In this way, according to the present invention, if dots of the same color are to be deposited at mutually adjacent positions, then a value corresponding to the direction of overlap, +α, is added to the count of the respective dots, and therefore, deposition interference can be prevented in an effective manner.

Next, a treatment liquid application control method relating to a third embodiment of the present invention will be described. In the present embodiment, when the dot deposition number is counted, weighting is given to cases where ink dots of the different colors are mutually adjacent. Therefore, in the present embodiment, a counter, Count, for counting the number of dots of different colors to be deposited at the same position is introduced.

Figure 14:
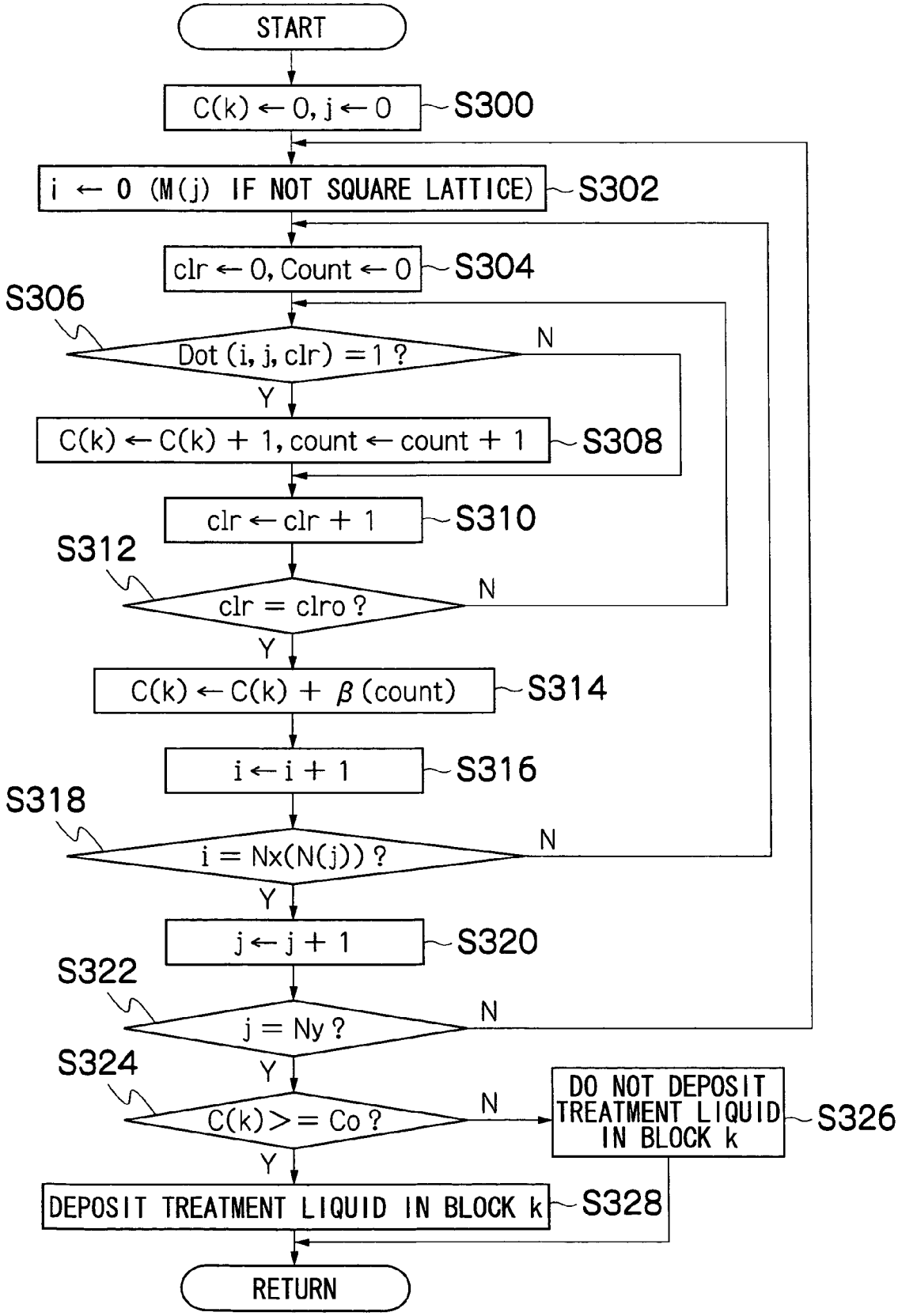
FIG. 14 is a flowchart showing a treatment liquid application control method according to the third embodiment of the present invention.

Below, the present embodiment is described with reference to the flowchart shown in FIG. 14.

Firstly, from step S300 until S304, the dot deposition number counter C(k), the j coordinate in the sub-scanning direction, the i coordinate in the main scanning direction, the ink color index clr, and the dot number counter, Count, for the dots of different colors to be deposited in the same pixel, are respectively initialized.

At step S306, it is judged whether or not an ink droplet of ink color clr is to be deposited onto the position (i, j), (in other words, whether or not Dot (i, j, clr)=1). If such a droplet is not to be deposited, then the procedure skips the next step, S308, and advances to step S310. If, on the other hand, an ink dot of the color clr is to be deposited at the position of coordinates (i, j), then at the next step S308, the counter C(k) and Count are respectively incremented by 1.

At the next step, S310, the index clr indicating the ink color is incremented by 1 and the procedure transfers to processing for the next color. At the next step, S312, it is judged whether or not the processing for all of the colors has been completed, and if processing for all of the colors has not yet been completed, then the procedure returns to step S306, where it is judged whether or not a dot of the color clr is to be deposited at the same position (i, j), for the remaining colors. If such a dot is to be deposited, then the counter C(k) and Count are respectively incremented by 1.

When the processing has been completed for all of the colors, at the next step, S314, the weighted value β(Count) corresponding to the number of dots, Count, of different colors which are to be deposited at the same position is added to the counter C(k).

If inks of four different colors are used, then Count may take a value from 0 to 4. Therefore, it is possible, for example, to set β(0)=0, β(1)=0, β(2)=1, β(3)=2, β(4)=3, or the like.

At the next step, S316, the i coordinate in the main scanning direction is incremented by 1 and the procedure transfers to processing for the next pixel. The subsequent processing is similar to that of the first or second embodiments described above, and detailed description thereof is omitted here.

In this way, according to the present embodiment, it is possible to prevent bleeding between colors, effectively, by adding a value corresponding to the respective colors, +β, to the count of the respective dots, when dots of different colors are to be deposited at the same pixel.

Next, a treatment liquid application control method relating to a fourth embodiment of the present invention will be described. In the present embodiment, when counting the number of dots to be deposited, the weighting value is changed according to the color.

Figure 15:
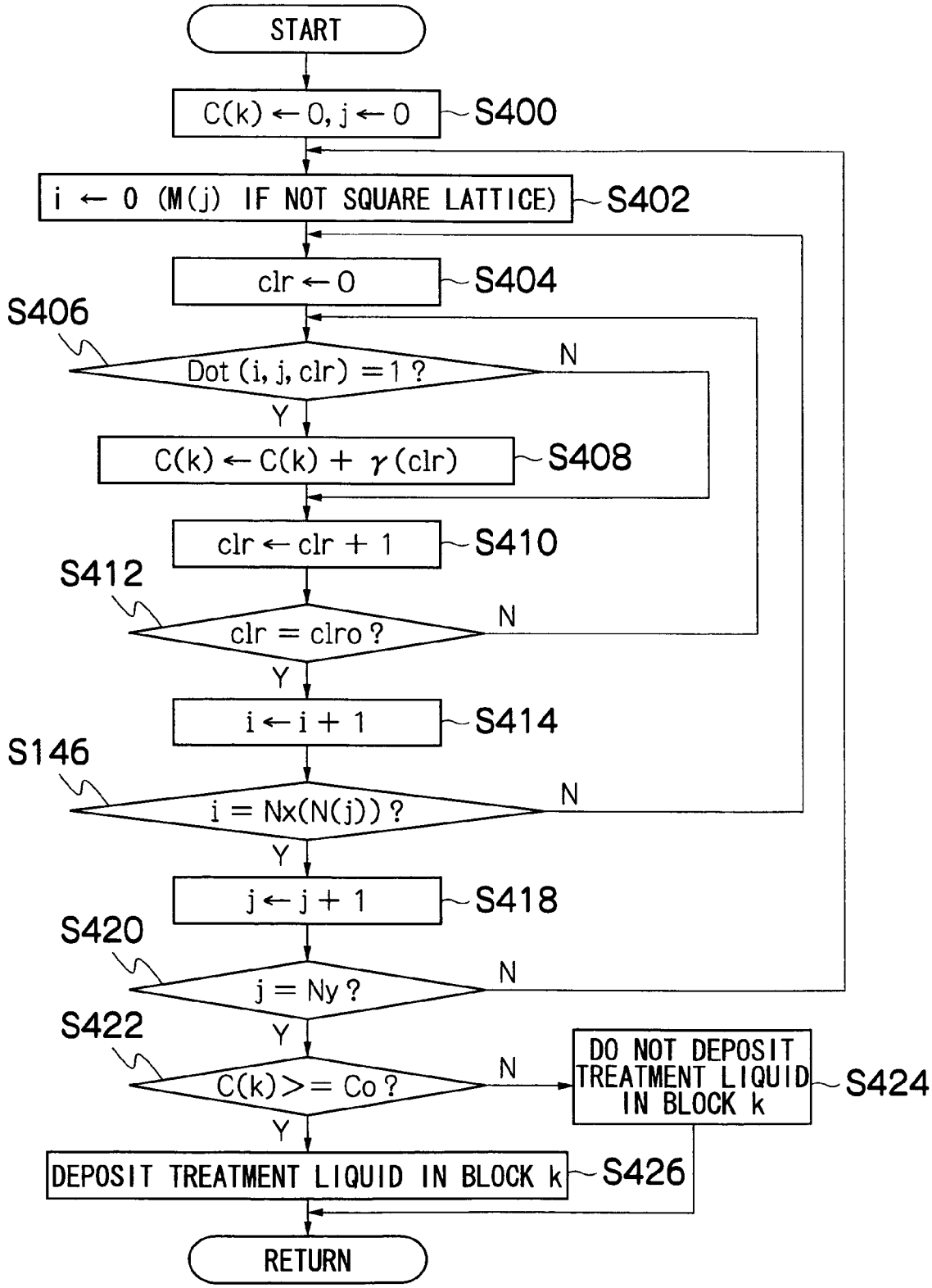
FIG. 15 is a flowchart showing a treatment liquid application control method according to the fourth embodiment of the present invention.

Below, the present embodiment is described with reference to the flowchart shown in FIG. 15.

Firstly, at step S400, the dot deposition number counter C(k) and the j coordinate in the sub-scanning direction are respectively initialized (substituted with a value of 0), and at step Second electrode group 402, the i coordinate in the main scanning direction is initialized (in the case of a square lattice, it is set to 0; and in other cases, it is substituted with M(j)). Moreover, at step S404, the index clr indicating the ink color is initialized (substituted with a value of 0).

Next, at step S406, it is judged whether or not a droplet of ink of ink color clr is to be deposited onto the position of coordinates (i, j), (in other words, whether or not Dot (i, j, clr)=1). If, as a result, no droplet is to be deposited, then the procedure skips all of the subsequent processing in step S408 and advances to step S410.

If, on the other hand, a droplet of ink of the color clr is to be deposited at the position of coordinates (i, j), then at the next step, S408, a weighting value corresponding to the color, γ(clr), is added to the counter C(k). Here, the weighting value corresponding to the color, γ(clr), is previously specified, for instance, as γ(0)=1, γ(1)=1, γ(2)=0.5, and γ(3)=2, in respect of the clr values, clr=0 (cyan), clr=1 (magenta), clr=2 (yellow), clr=3 (black).

At the next step, S410, the index clr indicating the ink color is incremented by 1 and the procedure transfers to processing for the next color. The processing subsequent to this step S410 is similar to the processing described in step S114 onwards in the first embodiment above, and detailed description thereof is omitted here.

In this way, according to the present embodiment, when one droplet of transparent treatment liquid is deposited onto each block, the value γ added to the evaluation value (the value of counter C(k)) is varied according to the ink, even in the case of the same single droplet. For example, the value γ added is increased in the case of dots of a particular color where image deterioration is notable (which can be expected to be black, for instance), whereas the value γ added is reduced in the case of dots of a particular color where image deterioration is small (which can be expected to be yellow, for instance). Accordingly, it is possible to prevent deposition interference in an effective manner.

As described above in particular with respect to a control method which decides how to deposit droplets of a transparent treatment liquid, firstly, before image formation, prescribed image processing is carried out with respect to input image data, the image forming region is divided into blocks on the basis of the obtained image data, and it is judged how treatment liquid is to be deposited in each block, by means of the respective embodiments described above.

When forming an image, a transparent treatment liquid is deposited onto the respective blocks in accordance with the judgment described above. A plurality of droplets of the transparent treatment liquid may be deposit in a regular pattern, but from the viewpoint of reducing the number of nozzles which eject treatment liquid, reducing the treatment liquid ejection frequency, and lowering the burden of the treatment liquid ejection control, and the like, it is desirable to deposit one droplet of the transparent treatment liquid having substantially the same size as the block, within each block, as shown in FIG. 8 and FIG. 9 and indicated in steps S11 to S23.

In the embodiment described above, treatment liquid ejection heads are disposed in front of the print heads, and ink is deposited after depositing the transparent treatment liquid, but if using a two-liquid reaction with the particular aim of preventing bleeding in ordinary paper, it is possible to change the sequence of droplet deposition of the transparent treatment liquid and the ink.

According to the present embodiment as described above, when judging whether or not to deposit droplets of a transparent treatment liquid, rather than comparing a value obtained by simply adding together the ink dot numbers to be deposited in each block with a certain fixed threshold value, as in the related art described in FIG. 16, the value added to the sum of the dot numbers is varied according to the dot size, and furthermore, processing is implemented in such a manner that a weighting is applied to this added value when the dots of the same color are mutually adjacent, a weighting is also applied when different colors are overlapping, and the added value is changed according to the color. Therefore, it is possible to prevent deposition interference between ink droplets, bleeding into a permeable medium, such as ordinary paper, and bleeding due to superimposition of ink droplets of different colors, in an effective manner.

Furthermore, since the droplet deposition density of the transparent treatment liquid is lower than the droplet deposition density (writing density) of the ink, then it is possible to reduce the number of nozzles for ejecting transparent treatment liquid, and it is also possible to reduce the ejection frequency of the transparent treatment liquid. Furthermore, the pressure chambers for ejecting transparent treatment liquid can be made larger, the ejection force can be increased, and transparent treatment liquid of higher viscosity can therefore be ejected.

Furthermore, since the image region is divided into blocks, and it is decided whether or not to deposit transparent treatment liquid in each region according to whether or not a prescribed number of droplets of ink are to be deposited therein, one droplet of transparent treatment liquid being deposited onto a block if treatment liquid is deposited, then droplets of transparent treatment liquid are not deposited onto blocks where no droplets of ink are to be deposited, and therefore, wrinkling of the recording paper can be reduced and the burden of solvent processing is also reduced.

Furthermore, since the transparent treatment liquid spreads in a substantially circular shape, then if the divisions between the blocks are formed as a hexagonal lattice shape when dividing the print region into blocks, the region covered by the transparent treatment liquid and the region of the block will coincide substantially, and hence deposition interference between respective droplets of transparent treatment liquid can be prevented, while at the same time, human observers will become less liable to distinguish the respective blocks and therefore image deterioration due to division into blocks will not occur.

Moreover, by setting the length of each edge of the divisions between the divided blocks to be 150 μm or less, then even if there is deposition interference of ink within a block in which transparent treatment liquid has not been deposited on the basis of the aforementioned judgment, it is possible to prevent the deposition interference from being visible within that block, and hence image quality can be improved.

Furthermore, after previously confirming the type of recording medium to be used in printing, the printer may change the manner of dividing the divided blocks, such as the length of each edge of the blocks, and/or the threshold value used to judge whether or not transparent treatment liquid is to be deposited, in accordance with the type of recording medium. In this case, the printer holds information relating to the diameter to which the transparent treatment liquid spreads, and the degree of deposition interference and bleeding between colors, for each type of recording medium. Thereby, it is possible to form an optimal image in accordance with the recording medium.

Furthermore, in the embodiments described above, the transparent treatment liquid is ejected from the inkjet head, but rather than ejecting the treatment liquid as droplets in this way, it is also possible to apply the treatment liquid to the recording medium by means of a very small contact-type stamping device. If a method of this kind is adopted, then the restrictions on the viscosity of the transparent treatment liquid are relaxed compared to a case where it is ejected from the inkjet head, and hence the range of usable treatment liquids is increased.

Moreover, in this case, in addition to the transparent treatment liquid, the ink may also be applied to the recording medium by means of a contact type dot forming device of this kind, thereby forming an image.

The image forming apparatus and the image forming method according to the present invention have been described in detail above, but the present invention is not limited to these examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink application device which applies droplets of ink having sizes different from each other to a recording medium;

a treatment liquid application device which applies treatment liquid which causes the ink to increase in viscosity or solidify, by reacting with the ink;

an image processing device which generates image data of multiple values from an input image, the multiple values corresponding to the sizes of the droplets of the ink;

a block dividing device which divides an image region to be formed on the recording medium according to the image data into a plurality of blocks, each of the blocks including a plurality of pixels;

an evaluation value calculation device which calculates an evaluation value for each of the blocks for judging an application of the treatment liquid to each of the blocks, according to the image data; and a treatment liquid application control device which controls a mode of applying the treatment liquid to each of the blocks, by comparing the evaluation value with a previously established threshold value, wherein the evaluation value calculation device calculates the evaluation value according to the image data by adding an additional value, and the larger the size of the droplet of the ink to be applied to the recording medium is, the larger the additional value to be added becomes.

2. The image forming apparatus as defined in claim 1, wherein the evaluation value calculation device calculates the evaluation value by taking account of at least one of an overlapping between the droplets of the ink on the recording medium, and a color of the ink, according to the image data.

3. The image forming apparatus as defined in claim 1, wherein when the treatment liquid application control device implements control whereby treatment liquid is applied to one of the blocks, then the treatment liquid application device applies one droplet of the treatment liquid to the one of the blocks.

4. The image forming apparatus as defined in claim 1, wherein the treatment liquid application device comprises a liquid ejection head which ejects the treatment liquid.

5. The image forming apparatus as defined in claim 1, wherein the blocks have a substantially hexagonal lattice shape.

6. The image forming apparatus as defined in claim 1, wherein a length of a maximum diameter of the blocks is 150 μor less.

7. The image forming apparatus as defined in claim 1, further comprising a threshold value recording device which records the threshold value in accordance with the recording medium.

8. An image forming method, comprising the steps of:

generating image data of multiple values from an input image;

dividing an image region to be formed on a recording medium according to the image data into a plurality of blocks, each of the blocks including a plurality of pixels;

calculating an evaluation value for judging whether or not to apply a treatment liquid causing ink to increase in viscosity or to solidify by reacting with the ink, onto each of the blocks, according to the image data for each of the blocks;

applying the treatment liquid to the recording medium while controlling a mode of applying the treatment liquid to each of the blocks, by comparing the evaluation value with a previously established threshold value; and applying droplets of the ink to the recording medium, wherein in the step of calculating the evaluation value, the evaluation value is calculated according to the image data by adding an additional value, and the larger a size of the droplet of the ink to be applied to the recording medium in the step of applying droplets of the ink is, the larger the additional value to be added becomes.

9. The image forming method as defined in claim 8, wherein in the step of calculating the evaluation value, the evaluation value is calculated for each of the blocks by taking account of whether or not the droplets of the ink of a same color applied to the recording medium are mutually adjacent, according to the image data.

10. The image forming method as defined in claim 8, wherein in the step of calculating the evaluation value, the evaluation value is calculated for each of the blocks by taking account of whether or not the droplets of the ink of different colors applied to the recording medium are mutually overlapping, according to the image data.

11. The image forming method as defined in claim 8, wherein in the step of calculating the evaluation value, the evaluation value is calculated for each of the blocks by taking account of a color of the droplets of the ink applied to the recording medium, according to the image data.

12. An image forming apparatus, comprising:

an ink application device which applies droplets of ink to a recording medium;

a conveyance device which conveys the recording medium in a sub-scanning direction relatively to the ink application device;

a treatment liquid application device which applies treatment liquid which causes the ink to increase in viscosity or solidify, by reacting with the ink;

an image processing device which generates image data of multiple values from an input image;

a block dividing device which divides an image region to be formed on the recording medium according to the image data into a plurality of blocks, each of the blocks including a plurality of pixels;

an evaluation value calculation device which calculates an evaluation value for judging an application of the treatment liquid to each of the blocks; and a treatment liquid application control device which controls a mode of applying the treatment liquid to each of the blocks, by comparing the evaluation value with a previously established threshold value, wherein the evaluation value calculation device calculates the evaluation value according to the image data by adding a weighting value in a case where the droplets of the ink of a same color are to be deposited adjacently to each other on the recording medium, and the weighting value in a case where the droplets of the ink of the same color are to be deposited adjacently to each other along the sub-scanning direction is larger than the weighting value in a case where the droplets of the ink of the same color are to be deposited adjacently to each other along a main scanning direction perpendicular to the sub-scanning direction.

13. An image forming apparatus, comprising:

an ink application device which applies droplets of ink to a recording medium;

a conveyance device which conveys the recording medium in a sub-scanning direction relatively to the ink application device;

a treatment liquid application device which applies treatment liquid which causes the ink to increase in viscosity or solidify, by reacting with the ink;

an image processing device which generates image data of multiple values from an input image;

a block dividing device which divides an image region to be formed on the recording medium according to the image data into a plurality of blocks, each of the blocks including a plurality of pixels;

an evaluation value calculation device which calculates an evaluation value for judging an application of the treatment liquid to each of the blocks; and a treatment liquid application control device which controls a mode of applying the treatment liquid to each of the blocks, by comparing the evaluation value with a previously established threshold value, wherein the evaluation value calculation device calculates the evaluation value according to the image data by adding a weighting value in a case where the droplets of the ink of a same color are to be deposited adjacently to each other on the recording medium, and the weighting value in a case where the droplets of the ink of the same color are to be deposited adjacently to each other along a main scanning direction perpendicular to the sub-scanning direction is larger than the weighting value in a case where the droplets of the ink of the same color are to be deposited adjacently to each other along the sub-scanning direction.

14. An image forming apparatus, comprising:

an ink application device which applies droplets of inks of different colors to a recording medium;

a treatment liquid application device which applies treatment liquid which causes the inks to increase in viscosity or solidify, by reacting with the inks;

an image processing device which generates image data of multiple values from an input image;

a block dividing device which divides an image region to be formed on the recording medium according to the image data into a plurality of blocks, each of the blocks including a plurality of pixels;

an evaluation value calculation device which calculates an evaluation value for judging an application of the treatment liquid to each of the blocks; and a treatment liquid application control device which controls a mode of applying the treatment liquid to each of the blocks, by comparing the evaluation value with a previously established threshold value, wherein the evaluation value calculation device calculates the evaluation value according to the image data by adding a weighting value in a case where the droplets of the inks of the different colors are to be deposited at a same position on the recording medium, and the larger a number of the different colors of the inks of the droplets to be deposited at the same position on the recording medium is, the larger the weighting value to be added becomes.

15. An image forming apparatus, comprising:

an ink application device which applies droplets of inks of different colors to a recording medium;

a treatment liquid application device which applies treatment liquid which causes the inks to increase in viscosity or solidify, by reacting with the inks;

an image processing device which generates image data of multiple values from an input image;

a block dividing device which divides an image region to be formed on the recording medium according to the image data into a plurality of blocks, each of the blocks including a plurality of pixels;

an evaluation value calculation device which calculates an evaluation value for judging an application of the treatment liquid to each of the blocks; and a treatment liquid application control device which controls a mode of applying the treatment liquid to each of the blocks, by comparing the evaluation value with a previously established threshold value, wherein the evaluation value calculation device calculates the evaluation value according to the image data by adding an additional value, and the higher a degree of image deterioration caused by the droplets of the ink of the color applied to the recording medium is, the larger the additional value to be added becomes.

16. An image forming method, comprising the steps of:

generating image data of multiple values from an input image;

dividing an image region to be formed on a recording medium according to the image data into a plurality of blocks, each of the blocks including a plurality of pixels;

calculating an evaluation value for judging whether or not to apply a treatment liquid causing ink to increase in viscosity or to solidify by reacting with the ink, onto each of the blocks, according to the image data for each of the blocks;

applying the treatment liquid to the recording medium while controlling a mode of applying the treatment liquid to each of the blocks, by comparing the evaluation value with a previously established threshold value; and applying droplets of the ink to the recording medium with an ink application device while conveying the recording medium in a sub-scanning direction relatively to the ink application device, wherein in the step of calculating the evaluation value, the evaluation value is calculated according to the image data by adding a weighting value in a case where the droplets of the ink of a same color are to be deposited adjacently to each other on the recording medium in the step of applying the droplets of the ink, and the weighting value in a case where the droplets of the ink of the same color are to be deposited adjacently to each other along the sub-scanning direction is larger than the weighting value in a case where the droplets of the ink of the same color are to be deposited adjacently to each other along a main scanning direction perpendicular to the sub-scanning direction.

17. An image forming method, comprising the steps of:

generating image data of multiple values from an input image;

dividing an image region to be formed on a recording medium according to the image data into a plurality of blocks, each of the blocks including a plurality of pixels;

calculating an evaluation value for judging whether or not to apply a treatment liquid causing ink to increase in viscosity or to solidify by reacting with the ink, onto each of the blocks, according to the image data for each of the blocks;

applying the treatment liquid to the recording medium while controlling a mode of applying the treatment liquid to each of the blocks, by comparing the evaluation value with a previously established threshold value; and applying droplets of the ink to the recording medium with an ink application device while conveying the recording medium in a sub-scanning direction relatively to the ink application device, wherein in the step of calculating the evaluation value, the evaluation value is calculated according to the image data by adding a weighting value in a case where the droplets of the ink of a same color are to be deposited adjacently to each other on the recording medium in the step of applying the droplets of the ink, and the weighting value in a case where the droplets of the ink of the same color are to be deposited adjacently to each other along a main scanning direction perpendicular to the sub-scanning direction is larger than the weighting value in a case where the droplets of the ink of the same color are to be deposited adjacently to each other along the sub-scanning direction.

18. An image forming method, comprising the steps of:

generating image data of multiple values from an input image;

dividing an image region to be formed on a recording medium according to the image data into a plurality of blocks, each of the blocks including a plurality of pixels;

calculating an evaluation value for judging whether or not to apply a treatment liquid causing inks of different colors to increase in viscosity or to solidify by reacting with the inks, onto each of the blocks, according to the image data for each of the blocks;

applying the treatment liquid to the recording medium while controlling a mode of applying the treatment liquid to each of the blocks, by comparing the evaluation value with a previously established threshold value; and applying droplets of the inks of the different colors to the recording medium, wherein in the step of calculating the evaluation value, the evaluation value is calculated according to the image data by adding a weighting value in a case where the droplets of the inks of the different colors are to be deposited at a same position on the recording medium in the step of applying the droplets of the inks, and the larger a number of the different colors of the inks of the droplets to be deposited at the same position on the recording medium is, the larger the weighting value to be added becomes.

19. An image forming method, comprising the steps of:

generating image data of multiple values from an input image;

dividing an image region to be formed on a recording medium according to the image data into a plurality of blocks, each of the blocks including a plurality of pixels;

calculating an evaluation value for judging whether or not to apply a treatment liquid causing inks of different colors to increase in viscosity or to solidify by reacting with the inks, onto each of the blocks, according to the image data for each of the blocks;

applying the treatment liquid to the recording medium while controlling a mode of applying the treatment liquid to each of the blocks, by comparing the evaluation value with a previously established threshold value; and applying droplets of the inks of the different colors to the recording medium, wherein in the step of calculating the evaluation value, the evaluation value is calculated according to the image data by adding an additional value, and the higher a degree of image deterioration caused by the droplets of the ink of the color applied to the recording medium in the step of applying the droplets of the inks is, the larger the additional value to be added becomes.

* * * * *